United States Patent [19]

Takojima

[11] 4,243,356

[45] Jan. 6, 1981

[54] QUICK COUPLER

[75] Inventor: Hyoichi Takojima, Yokohama, Japan

[73] Assignee: Caterpillar Mitsubishi Ltd., Tokyo, Japan

[21] Appl. No.: 8,983

[22] Filed: Feb. 5, 1979

[30] Foreign Application Priority Data

Mar. 30, 1978 [JP] Japan ..... 53-036089

[51] Int. Cl.[3] ..... E02F 3/81

[52] U.S. Cl. ..... 414/723; 37/117.5

[58] Field of Search ..... 280/477, 478 R, 478 A, 280/478 B; 414/686, 722–724; 37/117.5, 118; 172/272–275

[56] References Cited

U.S. PATENT DOCUMENTS

| | | | |
|---|---|---|---|
| 3,531,140 | 9/1970 | Di Vita | 280/477 |
| 3,606,052 | 9/1971 | Schurz | 414/723 |
| 3,760,883 | 9/1973 | Birk | 172/273 |
| 3,935,953 | 2/1976 | Stedman | 414/723 X |
| 4,090,725 | 5/1978 | Perin | 280/478 R X |
| 4,116,347 | 9/1978 | Uchida | 414/723 |

FOREIGN PATENT DOCUMENTS

| | | | |
|---|---|---|---|
| 1164323 | 2/1964 | Fed. Rep. of Germany | 414/723 |

*Primary Examiner*—Stephen G. Kunin
*Assistant Examiner*—Terrance L. Siemens
*Attorney, Agent, or Firm*—John W. Grant

[57] ABSTRACT

A quick coupler for detachably attaching an implement to an earthworking vehicle which is provided with a pair of lift arms and a pair of tilt links, the coupler including a hitch assembly having a pair of transversely spaced hitch members each rotatably connected to one of the lift arms and one of the tilt links and having upper and lower coupling elements in the upper and lower end portions thereof; a hook assembly having a pair of hook members fixed in transversely spaced positions on the back of the implement and each having upper and lower receiving portions in the upper and lower coupling elements of the hitch assembly, respectively, the hook assembly further including a locking member provided in the vicinity of the lower receiving portion of each hook member and rotatable into and out of a locking position interfering with a path of movement of the lower coupling element of the hitch member relative to the lower receiving portion of the hook member, the locking member being adapted to be locked in the locking position when the respective hitch and hook members are coupled together.

9 Claims, 31 Drawing Figures

204
206
202
210
220
222
230
232
234
235
242
246
252
254
256

204
206
210
220
230
232
242
222
337
339
346
347
352
356
362
363
364
366
334
202

QUICK COUPLER

DESCRIPTION

Field of the Invention

This invention relates to a quick coupler, and more particularly to a quick coupler for detachably attaching a working implement to an earthworking vehicle or the like which is provided with lift arms and tilt links.

BACKGROUND ART

The earthworking vehicles which are provided with lift arms and tilt links, like a loader, can perform various kinds of jobs according to the type of the implement attached thereto. For example, a loader which has a bucket attached as an implement can perform the jobs such as transferring loose products in harbor loading and unloading, reshuffling of yards, backfilling of piping ditches, or earth spreading. A loader which is equipped with a fork is useful for the transfer of palletized goods to and from warehouses, transfer of goods in the form of rolls or transferring and laying pipes in piping work. Therefore, a single earthworking vehicle can serve for multiple purposes by replaceably attaching thereto a bucket, fork, blade or other implements according to the nature of the work required.

As shown, for instance, in the specification and drawings of U.S. Pat. Nos. 3,760,883 issued Sept. 25, 1973, to B. D. Birk; 3,935,953 issued Feb. 3, 1976, to R. N. Stedman; and 4,116,347 issued Sept. 26, 1978, to T. Uchida; there have been known and in use various quick couplers which allow to attach a variety of implements quickly and detachably to an earthworking vehicle which is provided with lift arms and tilt links. However, as pointed out in detail in the specification of the above-mentioned U.S. Pat. No. 4,116,347, the known quick couplers invariably have drawbacks including complicated construction, high production cost, troubles which make the equipment inoperative within a short period of time, and inability of coupling the working implement securely and safely to the earthworking vehicle, and the like.

Furthermore, the specification and drawings of U.S. Pat. No. 4,116,347 issued Sept. 26, 1978, to T. Uchida discloses a quick coupler with a hitch which can be moved into stretched and folded states by a hydraulic operating means or a locking mechanism, similarly to the specification and drawings of the above-mentioned U.S. Pat. No. 4,116,347. This type of hitch is free from the above-mentioned drawbacks and capable of coupling working implements quickly and securely to the earthworking vehicle in an improved manner. However, there have still been problems for improving the hitch construction which is not yet simple enough due to the necessity for moving the whole hitch assembly into the stretched and folded states, incurring a production cost which is not sufficiently low enough.

Further, the specification and drawings of Japanese patent application No. 51-98784 disclose a quick coupler which is provided with a hitch assembly having an upper coupling element, a lower coupling element link means, and an intermediate coupling element consisting of a coupling block loosely fitted in the vicinity of a free end of the link means, and with a hook assembly having an upper receiving element, a lower receiving element and an intermediate receiving element consisting of a key-shaped element, securely preventing the hitch and hook assemblies from disengaging from each other in the forward and rearward directions by the engagement of the intermediate coupling and receiving elements. This type of quick coupler allows quick and secure attachment of a working implement to an earthworking vehicle suitably over a long period of time but still has a number of inherent problems in that its construction is not simple enough and its production cost is not low enough due to the necessity for the provision of the intermediate coupling elements on the hitch assembly in addition to the upper and lower coupling elements and the necessity for the provision of the intermediate receiving portion on the hook assembly in addition to the upper and lower receiving portions, and in that its operation is relatively complicated due to the necessity for rotating the intermediate coupling element of the hitch assembly by the tilt-back or tilt-forward operations while actuating other operating mechanisms in both the engaging and disengaging operations between the intermediate coupling element hitch of the hitch assembly and the intermediate receiving portion of the hook assembly, namely, in both the coupling and uncoupling operations of the hitch and hook.

SUMMARY OF THE INVENTION

With the foregoing in view, the present invention has as its main object the provision of a quick coupler which can detachably attach various implements to an earthworking vehicle securely and safely and which is considerably simplified in construction, extremely low in production cost and very easy to handle in operation, especially in the coupling operation.

According to the present invention, there is provided a quick coupler for detachably attaching an implement to an earthworking vehicle which is provided with a pair of lift arms and a pair of tilt links, the coupler comprising:

a hitch assembly including a pair of transversely spaced hitch members one of which hitch members having upper and lower end portions thereof rotatably linked to one of the tilt links and one of the lift arms, respectively, and the other one of the hitch members similarly having upper and lower end portions thereof rotatably linked to the other one of the tilt links and the other one of the lift arms, respectively, the hitch members each having an upper and lower coupling element respectively in the upper and lower end portions thereof;

a hook assembly fixedly mounted on the back of the implement and including a pair of transversely spaced hook members each having upper and lower end portions, an upper receiving portion in the upper end portion shaped to receive from beneath one upper coupling element of the hitch assembly for engagement with the front, top and rear surface portions thereof and a lower receiving portion in the lower end portion shaped to receive from behind one lower coupling element of the hitch assembly for engagement at least with the front surface portion thereof, a locking member rotatably mounted in the vicinity of the lower receiving portion of each hook member and normally having at least one portion thereof disposed in a normal position interfering with a path of movement taken by the lower coupling element of the hitch assembly when moved toward the lower receiving portion of the hook assembly for engagement therewith, the locking member being rotatable into a released position clear of the path of movement of the lower coupling element of the hitch member with the lower receiving portion of the corresponding hook member and into a locking position same as or proximal to the normal position as soon as the lower coupling element is engaged by the lower receiving portion of the hook member, the locking member being adapted to be held in the locking position by a force transmitted thereto from the lower coupling element of the hitch member and acting in a direction to disengage the lower coupling element from the lower receiving portion; and an unlocking mechanism linked to each locking member of the hook assembly to rotate the locking members from the locking position to the released position.

The above and other objects, features and advantages of the present invention will become apparent from the following description and the appended claims, taken in conjunction with the accompanying drawings which show by way of example preferred embodiments of the present invention.

BRIEF DESCRIPTION OF THE DRAWINGS

In the accompanying drawings:

FIG. 3 is an exploded perspective view of a second embodiment of the quick coupler according to the present invention;

DESCRIPTION OF THE PREFERRED EMBODIMENTS

The quick coupler according to the present invention is now described more particularly by way of preferred embodiments shown in the accompanying drawings.

Figure 1:
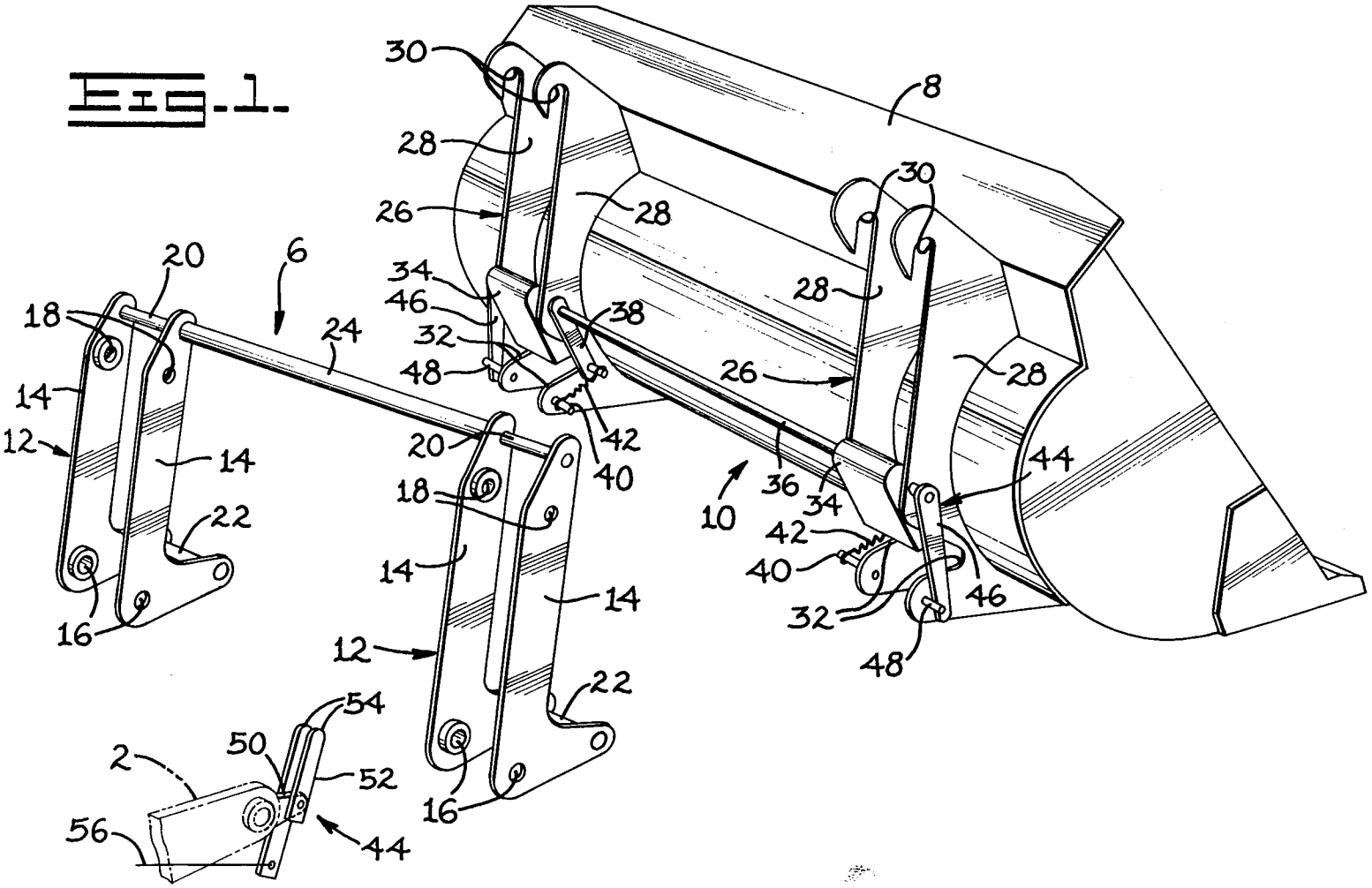
FIG. 1 is an exploded perspective view of a first embodiment of the quick coupler according to the present invention.

Referring primarily to FIG. 1, the quick coupler according to the present invention is provided with a hitch assembly 6 to be attached to the fore ends of a pair of lift arms 2 (partially shown by broken lines in FIG. 1 and FIGS. 2*a* through 2*f*) and to the fore ends of a pair of tilt links 4 (partially shown by broken lines in FIGS. 2*a* through 2*f*) of an earthworking vehicle, for instance, a loader (not shown), and with a hook assembly 10 which is fixedly secured to the back of a working implement 8 like a bucket to be detachably attached to the earthworking vehicle.

For more detailed explanation of the hitch assembly 6, it should be mentioned that the hitch assembly 6 in the particular embodiment shown in the drawings is provided with a pair of hitch members 12 which are transversely spaced from each other by a distance corresponding to the distance between the pair of lift arms 2 and between the pair of tilt links 4 on the earthworking vehicle. Each one of the paired hitch member 12 consists of a pair of hitch plates 14 substantially of the same shape which are transversely spaced from each other by a suitable distance. The paired hitch plates 14 of each hitch member 12 are positioned to hold the fore end of one lift arm 2 at position 16 close to the respective lower ends and rotatably connected to the lift arm 2 by a suitable means like a connecting pin. Further, the paired hitch plates 14 of each hitch member 12 are positioned to hold one tilt link 4 at position 18 close to the respective upper ends and rotatably connected to the tilt link 4 by suitable means such as a connecting pin. In other words, one of the paired hitch members 12 is rotatably connected at the upper and lower end portions thereof to one tilt link 4 and lift arm 2 while the other hitch member 12 is connected at the upper and lower end portions thereof to the other tilt link 4 and lift arm 2.

At the respective upper end portion (located above the position 18 in the case of the embodiment shown in the drawings), each one of the paired hitch members 12 is provided with an upper coupling member 20 which is constituted, for instance, by a pin mounted on the paired hitch plates 14. At the lower end portions (at a position forward of the position 16 in the case of the embodiment shown), each one of the paired hitch members 12 is provided with a lower coupling member 22 similarly mounted on the paired hitch plates 14. The upper and lower coupling members 20 and 22 may be mounted either rotatably or fixedly on the hitch members 12. Moreover, though not necessarily required, a connecting rod 24 may be provided to interconnect the upper end portions of inner hitch plates 14 of the respective hitch members 12 thereby to interlock the movement of the two hitch members 12 during the lifting operation by the lift arms 2 as well as during the tilting operation by the tilt links 4.

Referring now to the hook assembly 10 in greater detail, the hook assembly employed in the embodiment shown in the drawings is provided with a pair of hook members 26 which are transversely spaced from each other by a distance corresponding to the distance between the transversely spaced hitch members 12. Each one of the paired hook members 26 consists of a pair of hook plates 28 which are secured by welding or other suitable means to the back side of the working implement 8 in transversely spaced positions. The gap width between the paired hook plates 28 is slightly smaller than the gap width between the paired hitch plates 14, so that the hook plates 28 are positioned between the paired hitch plates 14 when the hitch assembly 6 and the hook assembly 10 are coupled with each other as will be explained hereinafter. Each one of the paired hook member 26 has at its upper end an upper receiving portion 30 which is formed to receive the upper coupling member 20 from beneath. The upper receiving portion 30 formed at the upper end of each hook plate 28 has a downwardly opened notched groove of substantially rectangular shape. Upon fitting the upper coupling member 20 of the hitch assembly 6 into the upper receptacle portion 30 of the hook assembly 10 for full engagement therewith, the upper receiving portion 30 is brought into contact with substantially the upper half of the upper coupling member 20 (more precisely, with the front, upper and rear surface portions of the upper coupling member 20), thereby blocking upward and back and forth movements of the upper coupling member 20 relative to the upper receiving portion 30 (see FIG. 2*a*). A lower receiving portion 32 is formed at the lower end of each one of the paired hook members 26 for receiving from beneath the lower coupling member 22 of the hitch assembly 6. In the particular embodiment shown, the lower receiving portion 32 is constituted by a rearwardly opened notched groove of substantially triangular shape with a forwardly reduced width. The lower coupling member 22 of the hitch assembly 6 is fitted from behind into the lower receiving portion 32 as will be described hereinafter. Upon fitting the lower coupling member 22 into the lower receiving portion 32 of the hook assembly 10 for sufficient engagement therewith, the lower receiving portion 32 is brought into contact with the front and lower circumferential portions of the lower coupling member 22, thereby blocking forward and downward movements of the lower coupling member 22 relative to the lower receiving portion 32 (see FIG. 2*c*).

Each one of the paired hook members 26 is further provided with a locking member 34 which is rotatably mounted at a position adjacent the above-mentioned lower receiving portion 32. In the particular embodiment shown, one end portion of the locking member 34 is secured between the paired hook plates 28 of each hook member 26 to a rod 36 which is extended through the respective hook members 26 and rotatably supported in the paired hook plates 28 at a position slightly over the notched grooves of the lower receiving portion 32. One end of a spring biased lever 38 is fixedly secured to the rod 36 at a position on the inner side of each hook member 26, the lever 38 having its free end connected to one end of a tension spring 42 the other end of which is connected to a pin 40 at the lower end of the hook member 26 to bias the lever 38 and therefore the rod 36 and locking member 34 clockwise in FIG. 1.

The quick coupler according to the present invention is further provided with an unlocking or lock releasing mechanism 44 which serves to release the locking member 34 for uncoupling the hitch assembly 6 and the hook assembly 10 as will be described in greater detail hereinafter. In the particular embodiment shown, the lock releasing mechanism 44 includes a manual operating lever 46 which is fixedly secured to each end of the aforementioned rod 36 which transversely projects beyond the respective paired hook member 26. On the other hand, a stopper pin 48 is fixed at the lower end of the outer hook plate 28 of each paired hook plates 28 for abutting engagement by the manual operating lever 46. Therefore, in the particular embodiment shown, the rod 36 which is biased clockwise in FIG. 1 by the action of the tension spring 42 has the fixed manual operating levers 46 at its opposite ends resiliently abutted against the stopper pins 48. Under these circumstances, the free end of the abovementioned locking member 34 projects into the space defined by the notched groove which constitutes the lower receiving portion 32 at the lower end of each hook plate 28, interfering with the path of movement of the lower coupling element 22 relative to the lower receiving portion 32 when engaging the lower coupling member 22 of the hitch assembly 6 with the lower receiving portion 32 of the hook assembly 10 as will be described in greater detail hereinafter.

The lock releasing mechanism 44 in the particular embodiment shown in the drawings is further provided with stopper members 52 which are rotatably mounted on the projections 50 at the fore ends of the respective lift arms 2 as shown in the lower left portion of FIG. 1 (only one stopper member is shown by broken lines). The fore end 54 of the stopper member 52 is contacted with the aforementioned locking member 34 as the necessity occurs when disengaging the hitch assembly 6 and hook assembly 10 from each other. Further, one end of a flexible wire 56 is connected to the lower extension of the stopper member 52. The other end of the flexible wire 56 is connected to a control lever (not shown) at the operator's station of the earthworking vehicle so that the stopper member 52 can be suitably rotated by manipulating the control lever at the operator's station. Namely, the flexible wire 56 can be operated at the operator's station of the earthworking vehicle when necessity occurs for rotating the stopper member 52 from there. Instead of the flexible wire 56, there may be employed a solenoid or the like in association with the stopper member 52, controlling the energization or de-energization of the solenoid at the operator's station of the earthworking vehicle when necessary thereby rotating the stopper member 52.

Reference is now had mainly to FIGS. 2*a* through 2*f* for the explanation of the operation for coupling the hitch assembly 6 with the hook assembly 10 or attaching the working implement 8 to the earthworking vehicle as well as the operation for uncoupling the hitch assembly 6 and the hook assembly 10 from each other or detaching the working implement 8 from the earthworking vehicle.

Figure 2C:
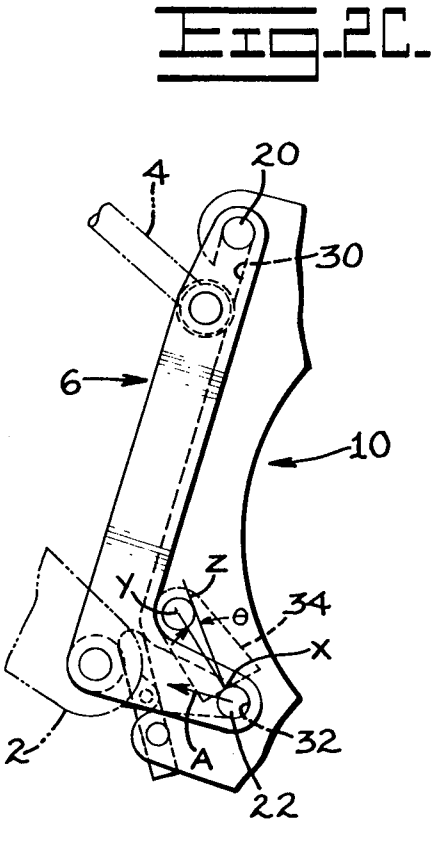
FIGS. 2*a* through 2*f* are fragmentary schematic views explanatory of the operations for coupling and uncoupling the hitch and hook assemblies in the first embodiment shown in FIG. 1.
Figure 2B:
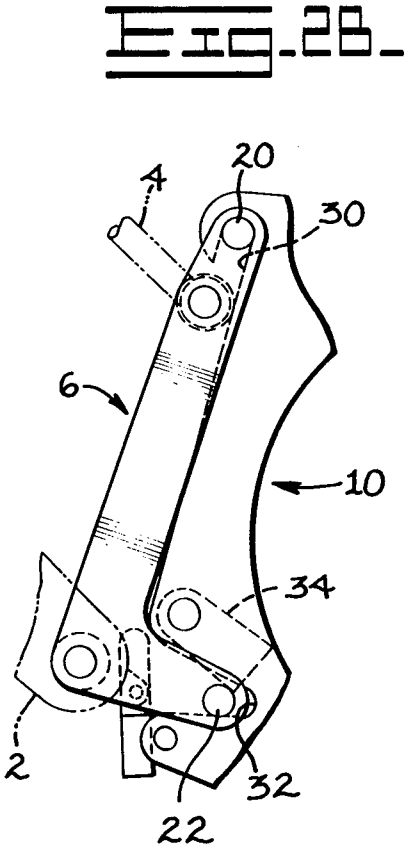
Figure 2A:
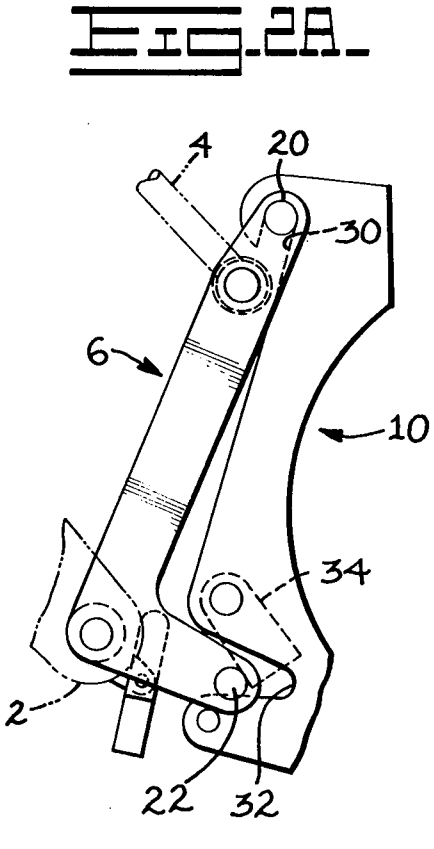

Referring to FIGS. 2*a* through 2*c*, in order to couple the hitch assembly 6 and the hook assembly 10 with each other, the earthworking vehicle is moved forward and at the same time the lift arms 2 and the tilt links 4 are operated to insert from beneath the upper coupling members 20 of the hitch assembly 6 into the upper receiving portion 30 of the hook assembly 10 at the back of the working implement 8 (FIG. 1) which is positioned on a supporting surface like the ground, thereby coupling the upper coupling members 20 of the hitch assembly 6 and the upper receiving portions 30 of the hook assembly 10 with each other (FIG. 2*a*). Thereafter, the lift arms 2 are raised slightly to hoist the hook assembly 10 and the working implement 8 into a pendant state hanging from the upper coupling members 20 of the hitch assembly 6, while slightly tilting back the tilt links 4, whereupon the working implement 8 and the hook assembly 10 on the working implement are swung clockwise in FIG. 2*a* about the upper coupling members 20 of the hitch assembly 6 due to the weight of the working implement 8. As a result, the lower coupling members 22 of the hitch assembly come close to the lower receiving portions 32 of the hook assembly 10 and consequently received in the latter. At this time, as shown in FIG. 2*a*, the free end of the locking member 34 which is provided in the vicinity of the lower receiving portion 32 of the hook assembly 10 projects into the space defined by the notched groove of the lower receiving portion 32 to interfere with the path of movement of the lower coupling member 22 relative to the lower receiving member 32, the lower coupling member 22 contacting the locking member 34 (FIG. 2*a*) to rotate the latter counterclockwise in FIGS. 2*a* and 2*b*. Namely, the locking members 34 which have been maintained in the normal position of FIG. 2*a* by the biasing action of the spring 42 are rotated by the lower coupling members 22 counterclockwise in FIGS. 2*a* and 2*b* into a released position deviated from the above-mentioned path of movement. As the lower coupling members 22 of the hitch assembly 6 are sufficiently fitted into the lower receiving portions 32 of the hook assembly 10 to have the lower coupling members 22 and the lower receiving portions 32 engaged with each other (FIG. 2*c*), the lower coupling members 22 reach beyond the free ends of the locking members 34 which are, by the gravity acting thereon and the biasing action of the spring 42, rotated clockwise in FIGS. 2*b* and 2*c* to return to the respective locking positions (shown in FIG. 2*c*) same as or a little short of the aforementioned normal positions with the respective free ends in engagement with the rear faces of the lower coupling members 22.

In this manner, the upper and lower coupling members 20 and 22 of the hitch assembly 6 are engaged respectively with the upper and lower receiving portions 30 and 32 of the hook assembly 10 and the locking members 34 are returned to the respective locking positions as shown in FIG. 2*c*, coupling the hitch assembly 6 and the hook assembly 10 securely with each other. Consequently, the working implement 8 is securely attached on the earthworking vehicle. The disengagement of the hitch assembly 6 and the hook assembly 10 in the upward or downward direction is prevented by the upper receiving portions 30 of the hook assembly 10 which engage the top side of the upper coupling members 20 of the hitch assembly 6 to block upward movement of the hitch assembly 6 relative to the hook assembly 10 and by the lower receiving portions 32 of the hook assembly 10 which engage the under side of the lower coupling members 22 of the hitch assembly 6 to block the downward movement of the hitch assembly 6 relative to the hook assembly 10. Moreover, the disengagement in the forward or rearward direction is prevented by the upper receiving portions 30 of the hook assembly 10 which engage the front side (right-hand surface portion in FIG. 2*c*) and the rear side (left-hand surface portion in FIG. 2*c*) of the upper coupling members 20 of the hitch assembly 6 to restrict the forward or rearward movement of the upper end portion of the hook assembly 10, and by the lower receiving portions 32 of the hook assembly 10 which engage the front side (right-hand surface portion in FIG. 2*c*) of the lower coupling members 22 of the hitch assembly 6 to restrict the forward or rearward movement of the lower end portion of the hitch assembly 6 relative to the lower end portion of the hook assembly 10 in cooperation with the locking members 34 of the hook assembly 10 which engage the rear side (left-hand surface portion in FIG. 2*c*) of the lower coupling members 22 of the hitch assembly.

In this instance, it is important that the engagement of the locking members 34 of the hook assembly 10 with the lower coupling members 22 of the hitch assembly 6, namely, the locking action of the locking members 34 on the lower coupling members 22 is not impaired by a strong force as indicated by arrow A which tends to disengage the lower coupling members 22 of the hitch assembly 6 from the lower receiving portions 32 of the hook assembly 10 turning the locking members 34 counterclockwise in FIG. 2*c*. For this purpose the angle $\theta$ formed by the line x-y connecting the contact point x between the locking member 34 and the lower coupling member 22 with the center of rotation y of the locking member 34 and the common normal line x-z at the contact point x should fundamentally satisfy the following condition;

$$0 \leqq \theta \leqq p$$

wherein the angle $\theta$ is positive when the line x-z is moving forward relative to the line x-y in FIG. 2*c* (namely, when in the state shown in FIG. 2*c*) and p is the angle of friction due to contact of the locking member 34 and the lower coupling member 22. Where the angle $\theta$ satisfies the above-mentioned condition, the force which is transmitted from the lower coupling member 22 to the locking member 34 due to the force of arrow A acts to rotate the locking member 34 clockwise in FIG. 2*c*, so that the locking member 34 is forced into the locking position and pressed against the lower coupling member 22 more firmly by the force of arrow A, thereby augmenting the locking action of the locking member 34 against the lower coupling member 22. Therefore, the locking members 34 can be maintained securely in the locking position without relying on the biasing force of the spring 42 (FIG. 1) and there is no possibility of the lower coupling members 22 being accidentally relieved of the locking action of the locking members 34 even when the spring 42 is broken.

In this instance, the locking member 34 is rotated clockwise in FIG. 2*c* to assume the locking position in engagement with the lower coupling member 22 so that it is theoretically impossible that the condition $\theta < 0$ is established.

Moreover, the importance of the relationship is referred to in the foregoing description. However, even if $\theta$ is greater than p, there is practically no problem as long as the value of $\theta - p$ is very small. This is because, where the value of $\theta - p$ is very small, the component which tends to rotate the locking member 34 counterclockwise in FIG. 2*c* is extremely small as compared with the force of arrow A which tends to disengage the lower coupling members 22 of the hitch assembly 6 from the lower receiving portions 32 of the hook assembly 10, so that the weight of the locking member 34 itself (or the gravity acting on the locking member 34) which tends to rotate the locking member 34 clockwise in FIG. 2*c* and/or the biasing force of the spring 42 well overcomes the above-mentioned component, maintaining the locking member 34 in its locking position.

In order for the angle $\theta$ to satisfy the condition of $0 \leqq \theta \leqq p$ in the case where the lower coupling member 22 of the hitch assembly 6 has a round sectional shape as in the embodiment shown in the drawings, the shape of the fore end of the locking member 34 is formed into an inclined straight surface or an eccentric arcuate surface having the length from the fore end face to the center of rotation increased gradually in the counterclockwise direction in FIG. 2*c* or into a concentric arcuate surface having the length from the fore end face to the center of rotation held constant (in this case, $\theta = 0$).

Thus, with the quick coupler according to the present invention, the locking members 34 are securely maintained in the locking positions without resorting to the action of the springs 42 (FIG. 1) which bias the respective locking members 34, so that the spring 42 (FIG. 1) may be omitted if it is guaranteed that the locking members 34 can return to the respective locking positions after the lower coupling members 22 of the hitch assembly 6 have been sufficiently inserted into the lower receiving portions 32 of the hook assembly beyond the free ends of the locking members 34. Accordingly, in the embodiment shown, the spring 42 (FIG. 1) can be dispensed with since one end of the locking member 34 is rotatably mounted on the rod 36 at a position above the lower receiving member 32 of the hook assembly, namely, above the path of movement of the lower coupling member 22 of the hitch assembly 6 relative to the lower receiving member 32 of the hook assembly 10 so that the locking member 34 is forced into the normal or locking position by its weight or by the gravity acting thereon. However, the gravity acting on the locking member 34 is relatively small and may be unable to overcome the frictional resistance to the rotation of the locking member 34 and the rod 36 (FIG. 1), failing to return the locking member 34 to the desired locking position. Therefore, even the embodiment shown in the drawings is preferred to be provided with the springs 42 (FIG. 1) to guarantee the safety.

Figure 2F:
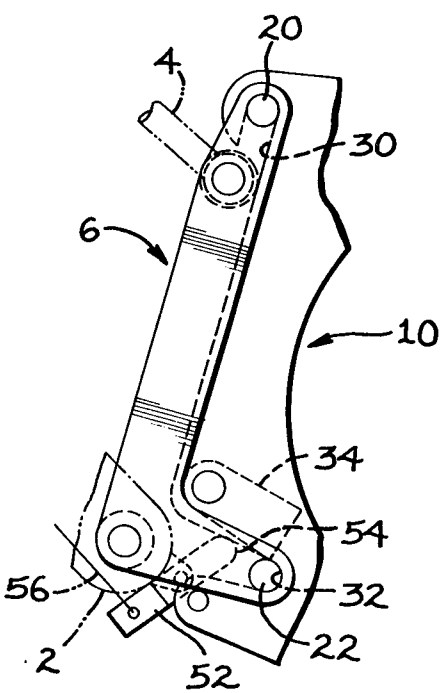
Figure 2E:
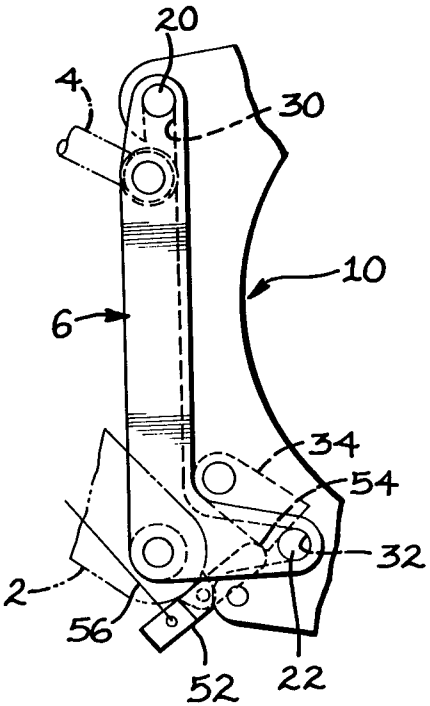
Figure 2D:
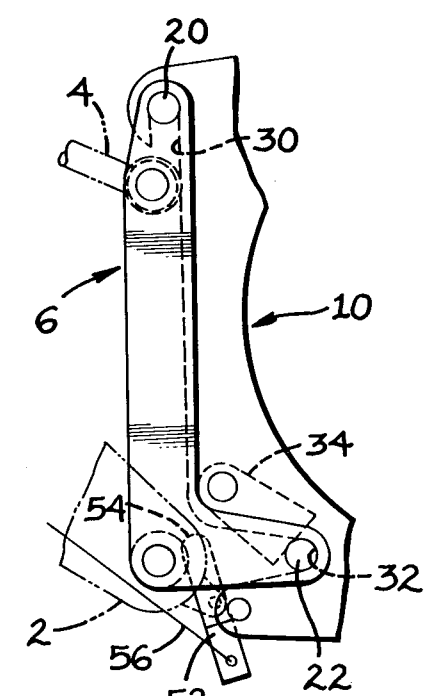

Turning now to the operation for uncoupling the hitch assembly 6 from the hook assembly 10, the lift arms 2 and the tilt links 4 are firstly operated to place the working implement 8 onto a supporting surface like the ground whenever it is desired to uncouple the hitch assembly 6 from the hook assembly 10. Nextly, the locking members 34 are rotated counterclockwise as seen in FIG. 2*c* by one of the methods which will be described hereinafter, moving the locking members 34 from the locking position (FIG. 2*c*) to the released position deviated from the path of movement of the lower coupling members 22 of the hitch assembly 6 relative to the lower receiving portions 32 of the hook assembly 10 (FIG. 2*f*). Thereafter, the lower coupling members 22 of the hitch assembly 6 are moved rearward relative to the lower receiving portions 32 of the hook assembly 10 by the reverse operation of the earthworking vehicle or by operation of the lift arms 2 and the tilt links 4, to disengage the lower coupling members 22 of the hitch assembly 5 from the lower receiving portions 32 of the hook assembly 10. Then, the upper coupling members 20 of the hitch assembly 6 are moved downward relative to the upper receiving portions 30 of the hook assembly 10 to disengage the upper coupling members 20 of the hitch assembly 6 from the upper receiving portions 30 of the hook assembly 16, whereupon the hitch assembly 6 is completely disconnected from the hook assembly 10.

In order to turn the locking members 34 from the respective locking positions to the released positions in the embodiment shown, either one of the following two methods may be resorted to.

The first method is to rotate the locking members 34 counterclockwise by manipulating the manual operating lever 46 which is connected to the locking members 34 through the rod 36, thereby turning the locking members 34 into the respective released positions.

The second method is to rotate the locking members 34 automatically into the respective released positions by operating the stopper members 52 from the operator's station on the earthworking vehicle. To explain this method more particularly with reference to FIGS. 2*d* through 2*f*, the lift arms 2 and the tilt links 4 are firstly operated to bring the working implement 8 into the position shown in FIG. 2*d*. Then, the control lever (not shown) which is provided at the operator's station and connected to the flexible wire 56 is operated to rotate the stopper member 52 clockwise in FIGS. 2*d* and 2*e*, moving the stopper member 52 from the inoperative position of FIG. 2*d* to the operative position of FIG. 2*e* in which the lower extension of the stopper member 52 is abutted against the lift arm, thereby abutting the fore end 54 of the stopper member 52 against the locking member 34. Thereafter, the tilt links 4 are tilted forward to rotate the hook assembly 10 and the working implement 8 together with the hitch assembly 6 clockwise in FIGS. 2*e* and 2*f* about the connecting point of the lift arm 2 and the hitch assembly 6. As a result, the locking member 34 is rotated counterclockwise in FIGS. 2*e* and 2*f* relative to the hook member 28 by the stopping action of the stopper member 52, moving the locking member 34 from the locking position of FIG. 2*e* to the unlocking position of FIG. 2*f*.

In the particular embodiment shown, the unlocking or lock releasing mechanism 44 is provided with the manual operating lever 46 as well as the stopper member and associated elements (i.e., the flexible wire 56 and the control lever) to allow the rotation into the released position of the locking member 34 either by the manual operation or by the automatic operation at the operator's station. However, one of the alternatives may be omitted if desired. A solenoid, the energization and de-energization of which can be controlled at the operator's station, may be provided in association with the locking member 34 or the manual operating lever 46 to rotate the locking member 34 directly into the released position by operation at the operator's station.

Now, reference is had to FIGS. 3 and 4*a* through 4*f* which show the second embodiment of the quick coupler according to the present invention.

The second embodiment shown in FIG. 3 adds some modifications to the locking member 34 and the lock releasing mechanism 44 of the first embodiment but employs the same constituent elements as in the first embodiment except the locking member and the lock releasing mechanism (same or like constituent elements of the second embodiment are designated by the same reference numerals as in the first embodiment).

In the second embodiment, a rod 136 which extends transversely between a pair of hook plates 28 is rotatably supported on the paired hook plates 28 at a position slightly over the lower receiving portion 32 of each one of the paired hook members 26. A pair of locking plates 135 which constitute a locking member 134 is fixed on the rod 136. The lower end of each one of the paired locking plates 135 is formed with a shoulder portion 137 (the function which will be explained hereinafter). A connecting pin 138 is fixed between the upper extended portions of the paired locking plates 135 and a tension spring 142 is connected to the connecting pin 138 and a pin 140 which is fixed between the paired hook plates 28. The tension spring 142 biases the locking member 134 to rotate clockwise as seen in FIG. 3 to maintain the locking member 134 resiliently in the normal position shown in FIG. 3. In the normal position, the free end portion or the lower portion of the locking member 134 projects into the space defined by the notched groove which constitutes the lower receiving portion 32 of the hook assembly 10 to interfere with the path of movement of the lower coupling member 22 relative to the lower receiving portion 32 when engaging the lower coupling member 22 of the hitch assembly 6 with the lower receiving portion 32 of the hook assembly 10.

As shown in the lower left portion of FIG. 3, the lock releasing mechanism 144 of the second embodiment is provided with a rod 151 which is rotatably supported on a projected portion 150 at the fore end of each one of the paired lift arms 2 (only one of which is shown by broken line), and with a stopper member 152 which is fixedly mounted on the rod 151. As will be described in greater detail hereinafter, when it is desired to uncouple the hitch assembly 6 from hook assembly 10 the stopper member 152 is rotated into its operative position to bring a pin 154 at its fore end into contact with one locking plate 135 of the aforementioned locking member 134. If desired, a manual operating layer 153 may be provided at the outer end of the rod 151 to rotate the stopper member 152 manually. The rod 151 has a connecting lever 155 connected to its inner end, the connecting lever 155 being linked to a similar connecting lever (not shown) which is fixedly mounted at the inner end of a rod (not shown) which is in turn rotatably supported on a projected portion of the other one of the paired lift arms 2 (not shown), through a transversely extending connecting rod 157. Moreover, the stopper member 152 is connected to one end of the flexible wire 156 the other end of which is connected to a control lever (not shown) at the operator's station of the earthworking vehicle. Therefore, the stopper member 152 can be rotated into a desired position either by directly operating the above-mentioned manual operating lever 153 or by operating the control lever which is provided at the operator's station of the earthworking vehicle.

Figures 4A, 4B, 4C:
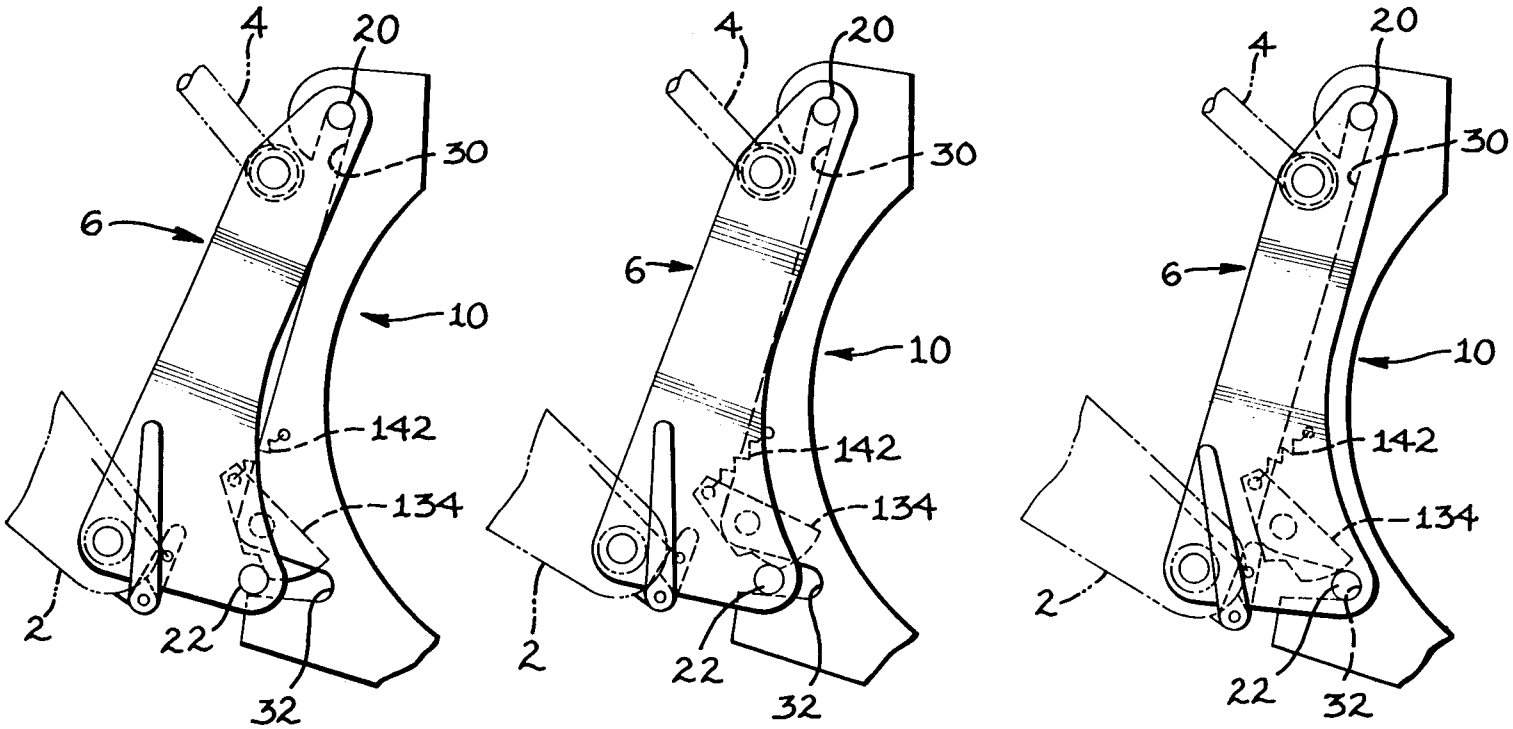
FIGS. 4*a* through 4*f* are fragmentary schematic views explanatory of the operations for coupling and uncoupling the hitch and hook assemblies in the second embodiment shown in FIG. 3.

As will be inferred from FIGS. 4*a* through 4*c* which correspond to FIGS. 2*a* through 2*c*, the procedures for coupling the hitch assembly 6 and the hook assembly 10 of the second embodiment or the procedures for attaching the working implement 8 to the earthworking vehicle are substantially same as in the first embodiment.

Figure 4F:
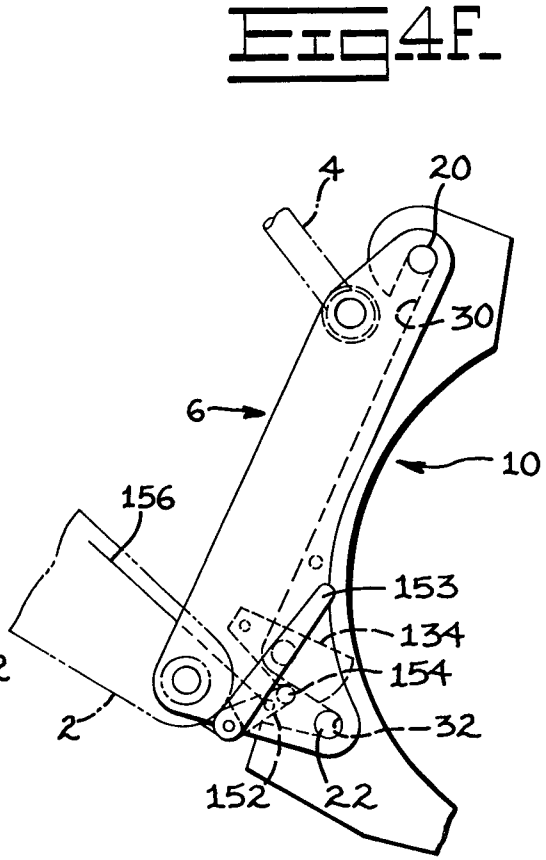
Figure 4E:
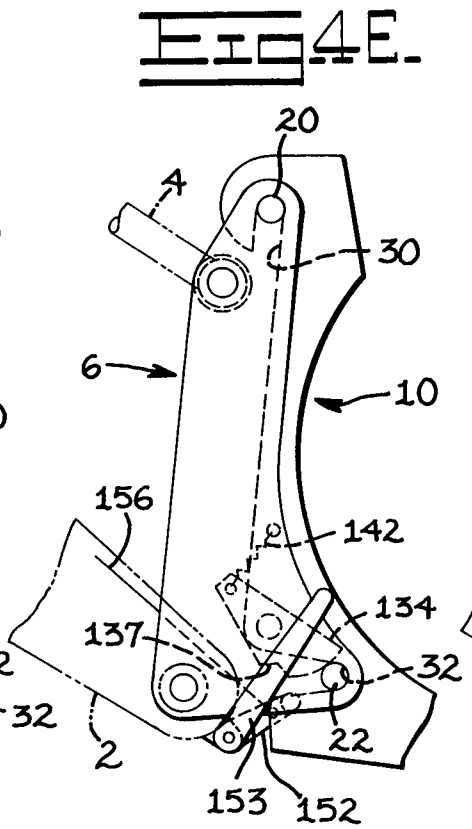
Figure 4D:
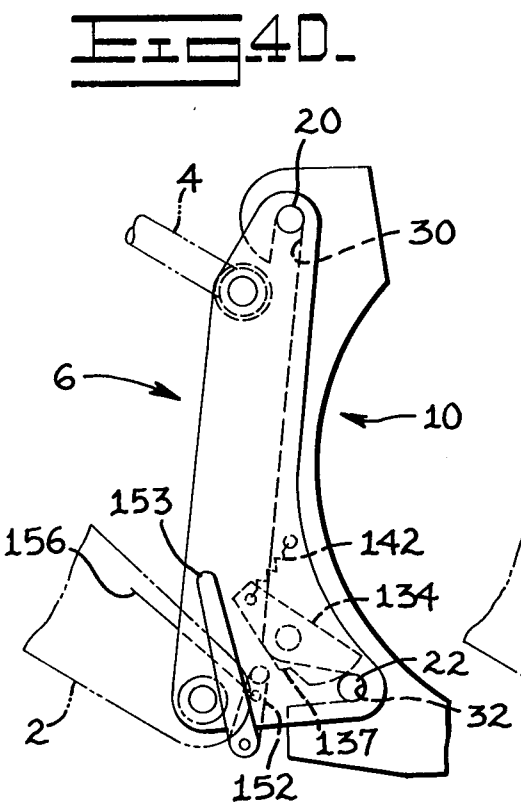

On the other hand, the procedures for uncoupling the hitch assembly 6 and the hook assembly 10 or the procedures for detaching the working implement 8 from the earthworking vehicle in the second embodiment are as follows. Referring to FIGS. 4*d* through 4*f*, in order to uncouple the hitch assembly 6 from the hook assembly 10, the lift arms 2 and the tilt links 4 are operated in the first place to bring the working implement 8 into the position shown in FIG. 4*d*. Then, the manual operating lever 153 connected to the stopper 152 is manually rotated clockwise as seen in FIG. 4*d* or the control lever (not shown) at the operator's station of the vehicle is operated to rotate the stopper member 152 clockwise in FIGS. 4*d* and 4*e* from the nonoperative position of FIG. 4*d* to the operative position of FIG. 4*e*. Thereafter, the tilt links 4 are tilted forward to rotate the hook assembly 10 and the working implement 8 together with the hitch assembly 6 clockwise as seen in FIGS. 4*e* and 4*f* and about the point of connection of the lift arm 2 and the hitch assembly 6. In this instance, the pin 154 (FIGS. 3 and 4*f*) at the fore end of the stopper member 152 is abutted against the front of the lower edge portion of the locking member 134 to impose its stopper action on the locking member 134. Whereupon, the locking member 134 is rotated relative to the hook member 26 counterclockwise as seen in FIGS. 4*e* and 4*f*, moving from the locking position of FIG. 4*e* to the released position of FIG. 4*f*. After this, by reverse operation of the earthworking vehile or by operation of the lift arms 2 and the tilt links 4, the lower coupling member 22 of the hitch assembly 6 are moved rearward relative to the lower receiving portions 32 of the hook assembly 10 to disengage the lower coupling member 22 of the hitch assembly 6 from the lower receiving portions 32 of the hook assembly 10. Then, the upper coupling members 20 of the hitch assembly 6 are moved downward relative to the upper receiving portions 30 of the hook assembly 10 to disengage the upper coupling members 20 of the hitch assembly 6 from the upper receiving portions 30 of the hook assembly, thereby completely detaching the hitch assembly 6 from the hook assembly. In this instance, upon moving the lower coupling members 22 of the hitch assembly 6 rearward relative to the lower receiving portions 32 of the hook assembly 10, the pin 154 at the fore end of the stopper member 152 which has been in contact with the front portion at the lower edge of the locking member 134 is moved relative to the lower edge of the locking member 134 and comes into contact with the rear portion of the locking member 134 behind the shoulder portion 137 thereof. As a result, the locking member 134 is rotated further counterclockwise from the released position of FIG. 4*f*, thereby preventing the locking member 134 from interfering with the movement of the lower coupling member 22 of the hitch assembly by contacting upper or rear surfaces thereof when moving the lower coupling member 22 of the hitch assembly 6 rearward relative to the lower receiving portion 32 of the hook assembly 10.

Now reference is had to FIGS. 5 and 6*a* through 6*g* which depict the third embodiment of the quick coupler according to the present invention.

Figures 5, 5A:
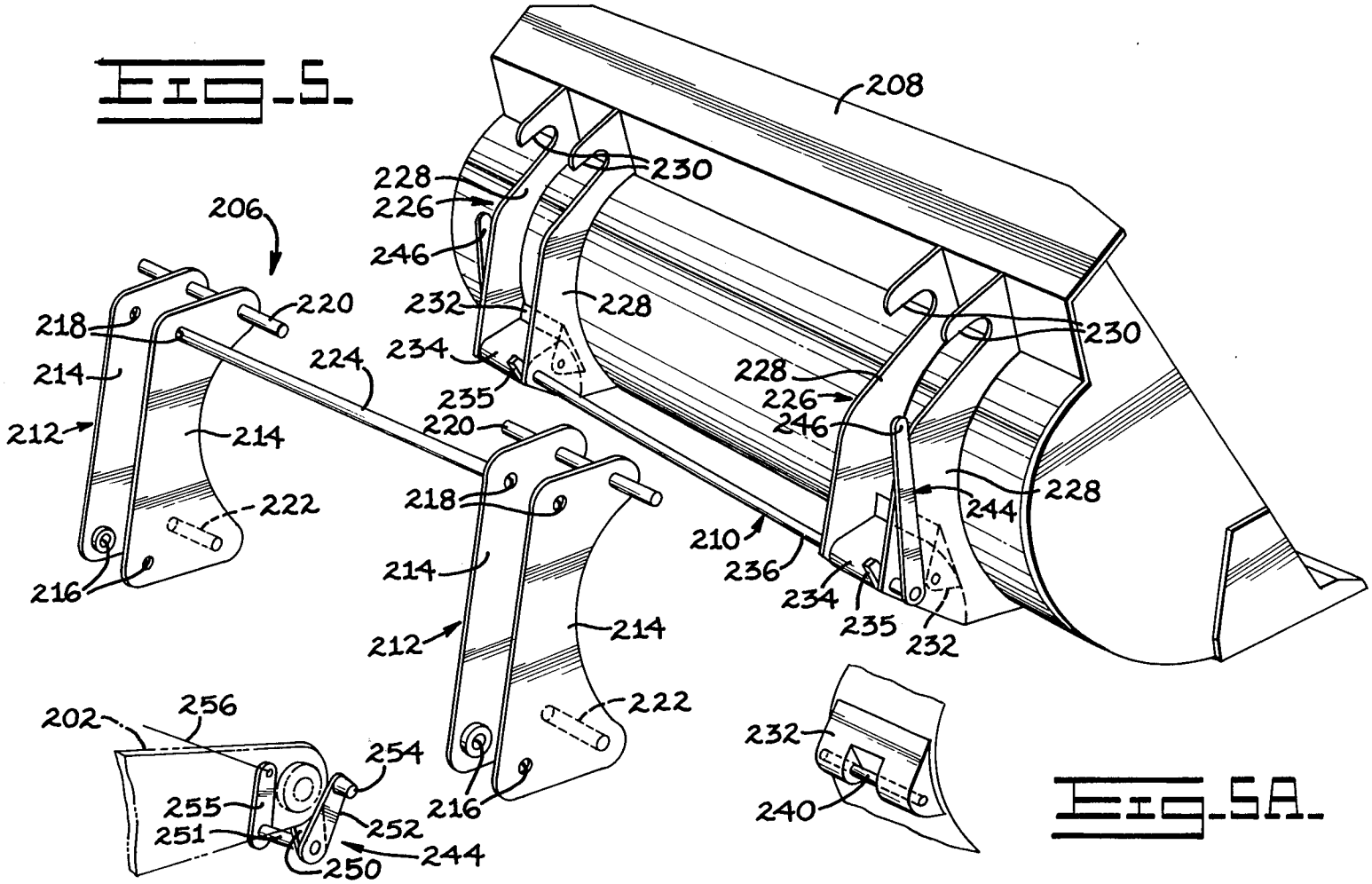
FIG. 5 is an exploded perspective view of a third embodiment of the quick coupler according to the present invention.
FIG. 5*a* is a perspective view of an element of the quick coupler of FIG. 5.

Referring primarily to FIG. 5, similarly to the foregoing first and second embodiments, the third embodiment includes a hitch assembly 206 to be connected to the fore ends of a pair of lift arms 202 (only one of which is shown by broken lines in FIGS. 5 and 6*a* through 6*f*) and the fore ends of a pair of tilt links 204 (only one of which is shown by broken lines in FIGS. 6*a* through 6*f*) of an earthworking vehicle like a loader (not shown) and a hook assembly 210 to be fixed at the back of a working implement 208 like a bucket to be detachably mounted on the earthworking vehicle.

More detailed description is given firstly with regard to the hitch assembly 206. The hitch assembly 206 in the third embodiment is provided with a pair of hitch members 212 which are transversely spaced from each other by a distance corresponding to the distance between the trnsversely spaced pairs of lift arms 202 and tilt links 204. Each one of the paired hitch members 212 is constituted by a pair of transversely spaced parallel hitch plates 214 substantially of the same shape. The paired hitch plates 214 of each hitch member 212 are positioned to hold the fore end of one lift arm 202 at position 216 adjacent the respective lower ends and rotatably connected to said one lift arm 202 by a connecting pin or other suitable means. Further, the paired hitch plates 214 of each hitch member 212 are positioned to hold one tilt link 204 at position 218 adjacent the respective upper ends and rotatably connected to said one tilt link 204 by a connecting pin or other suitable means. Namely, one of the paired hitch member 212 is rotatably connected at its upper and lower end portions to one tilt link 204 and lift arm 202 and the other hitch member is rotatably connected at its upper and lower end portions to the other tilt link 204 and lift arm 202.

At the upper end of each one of paired hitch member 212 (forward of the position 218 in the drawings), there is an upper coupling member 220 which is constituted by, for instance, a pin which is mounted on the paired hitch plates 214 with its both ends projected on opposite sides of the hitch plats 214. On the other hand, at the lower end of each one of the paired hitch member 212 (forward of the position 216 in the drawings), there is provided a lower coupling member 222 constituted by a pin which is mounted between the paired hitch plats 214. The upper coupling member 220 and the lower coupling member 222 may be rotatably or fixedly mounted on the hitch member 212. Furthermore, though not necessarily required, there may be provided a connecting rod 224 which connects the upper end portions of the inner hitch plates 214 of the respective hitch members 212 so that the hitch members 212 may move in interlocked relation with each other during the lifting operation by the lift arms 202 and the tilting operation by the tilt links 204.

Turning now to the hook assembly 210, the hook assembly 210 of the third embodiment is provided with a pair of hook members 226 which are fixed at the back of the working implement 208 in positions transversely spaced from each other by a distance corresponding to the distance between the paired hitch members 212. Each one of the paired hook members 226 consists of a pair of transversely spaced hook plates 228 which are fixed at the back of the working implement 208 by welding or other suitable means. Contrary to the first and second embodiments, the gap width between the paired hook plates 228 is slightly greater than the gap width between the paired hitch plates 214. As will be described hereinafter, the pair of hitch plates 214 are positioned between the pair of hook plates 228 when the hitch assembly 206 and hook assembly 210 are coupled with each other. The upper end of each hook member 226 is formed with an upper receiving portion 230 for receiving from beneath the upper coupling member 220 of the hitch assembly 206. This upper receiving portion 230 is formed at the upper end of each one of the paired hook plates 228 and constituted by a downwardly opened notched groove of substantially rectangular shape. When the upper coupling members 220 of the hitch assembly 206 are fitted into and brought full engagement with the upper receiving portion 230 of the hook assembly 210, the upper receiving portion 230 is caused to contact the upper half portion of the upper coupling member 220 (namely, the front, upper and rear surface portions of the upper coupling member 220) to block upward as well as back and forth movements of the upper coupling member 220 relative to the upper receiving portion 230 (see FIG. 6*a*). The lower end of each one of the paired hook members 226 is formed with a lower receiving portion 232 to receive from behind the lower coupling member 222 of the hitch assembly 206. This lower receiving portion 232 is constituted by a crescent shaped member which is directly fixed on the back of the working implement 208 by welding or other suitable means, in a position in the lower end portion or each hook member 226 and between the paired hook plates 228 (see FIG. 5*a*). The width of the crescent member which constitutes the lower receiving portion 232 is slightly smaller than the gap which between the paired hitch plates 214 which constitute each hitch member 212 of the hitch assembly 206. When the lower coupling members 222 of the hitch assembly 206 are engaged with the lower receiving portions 232 of the hook assembly 210 as will be described in greater detail hereinafter, the lower receiving portions 232 are caused to contact the front surface portions of the lower coupling members 222 to block forward movements of the lower coupling members 222 relative to the lower receiving portions 232 (see FIG. 6*c*).

Each hook member 226 is further provided with a locking member 234 which is rotatably mounted in the vicinity of the aforementioned lower receiving portion 232. In the third embodiment, a rod 236 is rotatably mounted on the hook plates 228, the rod 236 being extended transversely through both of the paired hook members 226 at a position rearward and upward of the crescent shaped member which constitutes the lower receiving portion 232. One end portion of the locking member 234 is fixed to the rod 236 between the paired hook plates 228 of each hook member 226. A tension spring 242 (see FIG. 6*a*) is connected between the lower front portion of the locking member 234 and a pin 240 which is mounted in a notch in the rear portion of the crescent shaped member of the lower receiving portion 232. The tension spring 242 biases the locking member 234 to rotate counterclockwise as seen in FIG. 6*a*, maintaining the locking member 234 in the normal position shown in FIG. 6*a*. In the normal position, the free end portion (more particularly, the upper front portion) of the locking member 234 interferes with the path of movement of the lower coupling member 222 toward the lower receiving portion 232 when the lower coupling member 222 of the hitch assembly 206 is engaged with the lower receiving member of the hook assembly 210 as will be described hereinafter.

The third embodiment is further provided with a lock releasing mechanism 244 which, as will be described hereinafter, operates the locking member 234 when uncoupling the hitch assembly 206 and hook assembly 210. In the third embodiment, the lock releasing mechanism is provided with a manual operating lever 246 fixed at least at one end (both ends in the drawings) of the aforementioned rod 236 which transversely projects beyond the respective hook members 226. The lock releasing mechanism 244 is further provided with a stopper member 252 which is fixedly mounted at the outer end of a rod 251 which is in turn rotatably supported on the projected portion 250 at the lower edge of the fore end of each one of the paired lift arms 202 (only one of which is shown by broken lines). As will be described hereinafter, a stopper member 252 is rotated into an operative position as the necessity occurs for disconnecting the hitch assembly 206 and hook assembly 210 thereby bringing a contact member 254 at its fore end into contact with a projected portion 235 of the locking member 234. A lever 255 has one end thereof fixed to the inner end of the rod 251 which is fixedly connected to the stopper member 252, the other end of the lever 255 being connected to one end of a flexible wire 256. The other end of the flexible wire 256 is connected to a control lever (not shown) at the operator's station of the earthworking vehicle, so that the stopper member 252 may be rotated as desired by operating the control lever at the operator's station of the vehicle. Namely, the flexible wire 256 constitutes a means for rotating the stopper member 252 at the operator's station of the earthworking vehicle when necessity occurs. Of course, a solenoid or other suitable means the energization or de-energization of which can be controlled at the operator's station of the vehicle may be provided in association with the stopper member 252 thereby to rotate the stopper member 252 when necessary.

Now, reference is had primarily to FIGS. 6*a* through 6*g* for explanation of the operation for coupling the hitch assembly 206 and hook assembly 210 or the operation for attaching the working implement 208 to the earthworking vehicle as well as the operation for uncoupling the hitch assembly 206 and hook assembly 210 or the operation for detaching the working implement 208 from the earthworking vehicle.

Figure 6C:
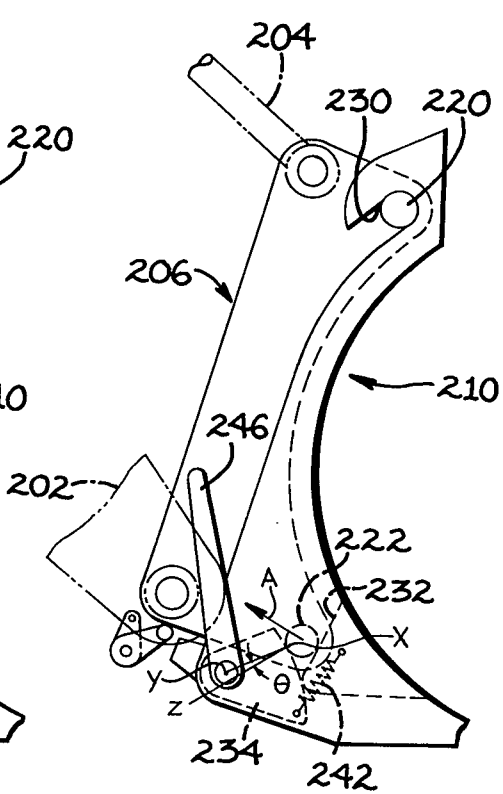
FIGS. 6*a* through 6*g* are fragmentary schematic views explanatory of the operations for coupling and uncoupling the hitch and hook assemblies in the third embodiment shown in FIG. 5.
Figure 6B:
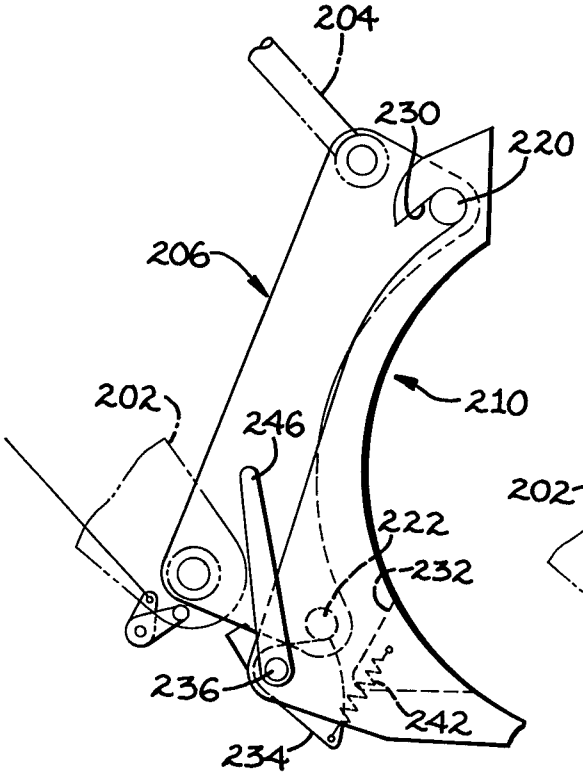
Figure 6A:
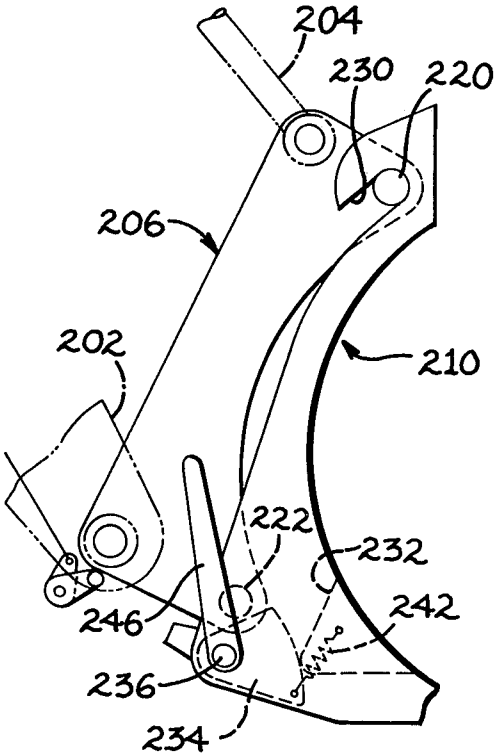

The description if firstly directed to the operation for coupling the hitch assembly 206 and hook assembly 210 with reference to FIGS. 6*a* through 6*c*. In order to couple the hitch assembly 206 with the hook assembly 210, the earthworking vehicle is moved forward and the lift arms 202 and tilt links 204 are operated in the first place to insert from beneath the upper coupling members 220 of the hitch assembly 206 into the upper receiving portions 230 of the hook assembly 210 at the back of the working implement 208 (FIG. 5) which is placed on a supporting surface like the ground, thereby engaging the upper coupling members 220 of the hitch assembly 206 with the respective upper receiving portions 230 of the hook assembly 230. Thereafter, the lift arms 202 are raised a little to hand the hook assembly 210 and the working implement 208 form the upper coupling members 220 of the hitch assembly 206, while slightly tilting back the tilt liks 204 to cause the working implement 208 and the hook assembly to rotate due to the weight of the working implement 208 clockwise as seen in FIG. 6*a* about the upper coupling members 220 of the hitch assembly 206. As a result, the lower coupling members 220 of the hitch assembly 206 are brought closer to the lower receiving portions 232 of the hook assembly 210 and fitted thereinto. In this instance, as shown in FIG. 6*a*, the free end of the locking member 234 which is provided in the vicinity of lower receiving portion 232 of the hook assembly 210 projects into and interferes with the path of movement of the lower coupling member 222 toward the lower receiving portion 232, so that the lower coupling member 222 contacts the locking member 234 (FIG. 6*a*) and causes same to rotate clockwise as seen in FIGS. 6*a* and 6*b*. Namely, the locking member 234 which has been maintained in the normal position of FIG. 6*a* by the biasing action of the spring 242 is urged by the lower coupling member 222 to rotate clockwise in FIGS. 6*a* and 6*b* into the released position deviated from the aforementioned path of movement. As soon as the lower coupling members 222 of the hitch assembly 206 are fully inserted and engaged with the lower receiving portions 232 of the hook assembly 210 (FIG. 6*c*), the lower coupling member 222 reaches beyond the free end of the locking member 234 which is as a result rotated counterclockwise as seen in FIGS. 6*b* and 6*c* by the biasing action of the spring 242, returning to the locking position (shown in FIG. 6*c*) same as or a little short of the normal position with the free end of the locking member in engagement with the under and rear sides of the lower coupling member 222.

In this way, the upper and lower coupling members 220 and 222 of the hitch assembly 206 are engaged respectively with the upper and lower receiving portions 230 and 232 of the hook assembly 210 and the locking member 234 is returned to the locking position as shown in FIG. 6*c*, securely coupling the hitch assembly 206 with the hook assembly, in other words, securely attaching the working implement 208 to the earthworking vehicle. Disengagement of the hitch assembly 206 and hook assembly 210 in the upward or downward direction is securely prevented by the upper receiving member 230 of the hook assembly 210 which engages the top surface of the upper coupling member 220 of the hitch assembly 206 to block upward movement of the hitch assembly 206 relative to the hook assembly 210 and by the locking member 234 of the hook assembly 210 which engages the under and rear sides of the lower coupling member 222 of the hitch assembly 206 to block downward movement of the hitch assembly 206 relative to the hook assembly 210. On the other hand, disengagement of the hitch assembly 206 and hook assembly 210 in the forward or rearward direction is securely prevented by the upper receiving member 230 of the hook assembly 210 which engages the front surface portion (the right-hand surface portion in FIG. 6*c*) and rear surface portion (the left-hand surface portion in FIG. 6*c*) of the upper coupling member 220 of the hitch assembly 206 to block forward or rearward movement of the upper end portion of the hitch assembly 206 relative to the upper end portion of the hook assembly 210 as well as by the lower receiving portion 232 of the hook assembly 210 which engages the front surface portion (the right-hand surface portion in FIG. 6*c*) of the lower coupling member 222 of the hitch assembly 206 and by the locking member 234 of the hook assembly 210 which engages under and rear surface portions (the lower right surface portion in FIG. 6*c*) of the lower coupling member 222 of the hitch assembly 206, thereby blocking forward or rearward movement of the lower end portions of the hitch assembly 206 relative to the lower end portion of the hook assembly 210.

In this connection, it is important that the engagement between the locking member 234 of the hook assembly 210 and the lower coupling member 222 of the hitch assembly 206, namely, the locking action by the locking member 234 on the lower coupling member 222 should not be impaired by the strong force indicated by arrow A which tends to disengage the lower coupling member 222 of the hitch assembly 206 from the lower receiving portion 232 of the hook assembly 210, rotating the locking member 234 clockwise as seen in FIG. 6*c*. For this purpose, as mentioned hereinbefore, the angle formed by the line x-y connecting the contacting point x between the locking member 222 and the center of rotation y of the locking member 234 and the common normal line x-z at the contacting point x should basically satisfy the following conditions:

$$0 \leqq \theta \leqq P$$

wherein the angle $\theta$ is positive when the x-z is advancing counterclockwise in FIG. 6*c* relative to the line x-y (viz., in the state shown in FIG. 6*c*) and is the angle of friction due to contact between the locking member 234 and the lower coupling member 222. Where the angle $\theta$ satisfied the above-mentioned conditions, the force which is transmitted from the lower coupling member 222 to the locking member 234 due to the force of arrow A acts to turn the locking member 234 counterclockwise in FIG. 6*c*, forcing the locking member 234 in the locking position and pressing same more firmly against the lower coupling member 222 to strengthen the locking action of the locking member 234 against the lower coupling member 222. Therefore, the locking member 234 can be securely maintained in the locking position without relying on the biasing action of the spring 242 or even when the spring 242 is broken, precluding the possibility of the lower coupling member 222 being accidentally released from the locking member 234.

In the first and second embodiments, as already mentioned hereinbefore, the one end of the locking member 34 or 134 is rotatably mounted on the rod 36 or 136 at a position above the lower receiving portion 32 of the hook assembly 10 or above the path of movement of the lower coupling member 22 of the hitch assembly 6 toward the lower receiving portion 32 of the hook assembly 10, so that the locking member 34 or 134 is forced into the normal or locking position by its own weight or by the gravity acting thereon, allowing omission of the spring 42 or 142. However, in the third embodiment, one end of the locking member 234 is rotatably mounted on the rod 236 at a position below the lower receiving portion 232 of the hook assembly 210 or below the path of movement of the lower coupling member 222 of the hitch assembly 206 toward the lower receiving portion 232 of the hook assembly 210. Accordingly, in the third embodiment, the weight of the locking member 234 or the gravity acting on the locking member 234 acts to rotate the locking member 234 clockwise in FIG. 6*c* into the released position (FIG. 6*b*). Therefore, the spring 242 is indispensable in the third embodiment in order to apply counterclockwise biasing force to the locking member 234 thereby rotating the locking member 234 counterclockwise in FIGS. 6*b* and 6*c* into the locking position of FIG. 6*c* when the lower coupling member 222 of the hitch assembly 206 reaches beyond the free end of the locking member 234 for full engagement with the lower receiving portion 232 of the hook assembly 210.

On the other hand, in the third embodiment the lower receiving portion 232 engages only with the front surface portion and not with the underside portion of the lower coupling member 222 of the hitch assembly 206 but instead the locking member 234 engages the underside and rear surface portions of the lower coupling member 222, with the following advantages over the first and second embodiments. Namely, in the third embodiment, even if frictional wear occurs to the engaging portions between the upper coupling member 220 of the hitch assembly 206 and/or between the lower coupling member 222 of the hitch assembly 206 and the lower receiving portion of the hook assembly 210, the locking position of the locking member 234 is automatically shifted in compensation therefor, precluding rattling of the engaging portions which would otherwise occur due to the frictional wear.

Description is now directed to the operation for uncoupling the hitch assembly 206 from the hook assembly 210. In order to uncouple the hitch assembly 206 from the hook assembly 210, the lift arms 202 and tilt links 204 are operated in the first place to put down the working implement 208 on a supporting surface like the ground. Then, by one of the methods which will be explained hereinafter, the locking member 234 is rotated clockwise in FIG. 6*c* from its locking position (FIG. 6*c*) to the released position, namely, to the position free of the path of movement of the lower coupling member 222 of the hitch assembly 206 relative to the lower receiving portion 232 of the hook assembly (see FIG. 6*f* or 6*g*). Thereafter, by reverse operation of the earthworking vehicle or by operation of the lift arms 292 and tilt links 204, the lower coupling member 222 of the hitch assembly 206 are moved rearward relative to the lower receiving portions 232 of the hook assembly 210 to disengage the lower coupling members 222 of the hitch assembly 206 from the lower receiving portions 232 of the hook assembly 210, and then the upper coupling members 220 of the hitch assembly 206 are moved downward relative to the upper receiving portions 230 of the hook assembly 210 to disengage the upper coupling members 220 of the hitch assembly 206 from the upper receiving portions 230 of the hook assembly 210, whereupon the hitch assembly 206 is completely detached from the hook assembly 210.

Either one of the following methods may be adopted in rotating the locking member 234 from its locking position to the released position.

Figures 6D, 6E, 6F, 6G:
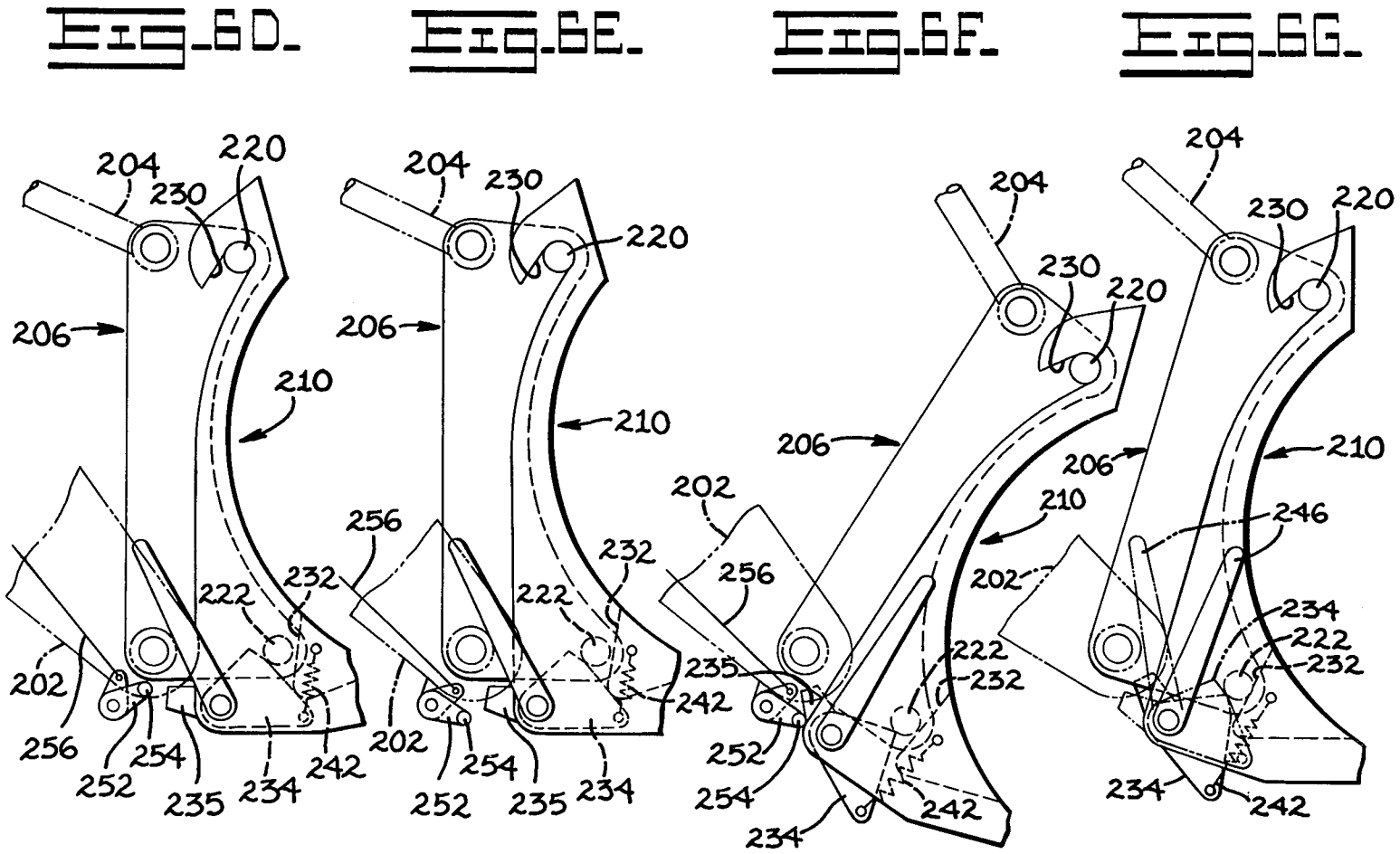

The first method is to rotate the locking member 234 to the released position manually by turning the manual operation lever 246 which is connected to the locking member 234 through the rod 236, clockwise in FIG. 6*g* from the position shown by two-dot chain line to the position indicated by solid line.

The second method is to rotate the locking member 234 automatically into the released position by operating the stopper member 252 from the operator's station of the earthworking vehicle. This method is explained more particularly with reference to FIGS. 6*d* through 6*f*. The lift arms 202 and tilt links 204 are operated in the first place to bring the working implement 208 into the state shown in FIG. 6*d*. Then, the control lever (not shown) at the operator's station which is connected to one end of the flexible wire 256 is operated to rotate the stopper 252 clockwise from the nonoperative position of FIG. 6*d* to the operative position shown in FIG. 6*e*. Thereafter, the tilt links 202 are tilted forward to rotate the hook assembly 210 and working implement 208 together with the hitch assembly 206 clockwise in FIGS. 6*e* and 6*f* about the point of connection between the lift arms 202 and the hitch assembly 206. Whereupon, the contact member 254 of the stopper member 252 is abutted against the projecting portion 235 of the locking member 234, urging the locking member 234 to rotate clockwise in FIG. 6*f* relative to the hook member 226 from the locking position of FIG. 6*e* to the released position of FIG. 6*f*.

Similarly to the first embodiment, the lock releasing mechanism 244 of the third embodiment is also provided with the manual operating lever 246 as well as the stopper member 252 and associated elements (viz., flexible wire 256 and control lever) so that the rotation to the released position of the locking member 234 may be effected either by manual operation or by automatic operation at the operator's station. However, one of these alternatives may be omitted if necessary. Alternatively, a solenoid or other suitable means the energization and de-energization of which can be controlled at the operator's station of the earthworking vehicle may be provided in association with the locking member 234 or the manual operating lever 246 thereby to rotate the locking member 234 directly into the released position by operation at the operator's station of the vehicle.

Reference is now had to FIGS. 7 and 8*a* through 8*g* which show the fourth embodiment of the quick coupler according to the present invention.

The fourth embodiment shown in FIG. 7 adds some alterations or modifications to the above-described third embodiment as follows. Firstly, an auxiliary locking member which constitutes a safety mechanism is added to lock the locking member in the locking position as soon as the lower coupling member of the hitch assembly engages the lower receiving portion of the hook assembly and the locking member returns to its locking position. Secondly, before the locking member is rotated to its released position from its locking position by the lock releasing mechanism the auxiliary locking member is rotated from its operative position to a nonoperative position to relieve the locking member from its locking action. Except for the above-mentioned first and second alterations or modifications, the fourth embodiment is substantially same as the third embodiment (those constituent elements of the fourth embodiment which are substantially same as in the third embodiment are designated by like reference numerals).

Figure 7:
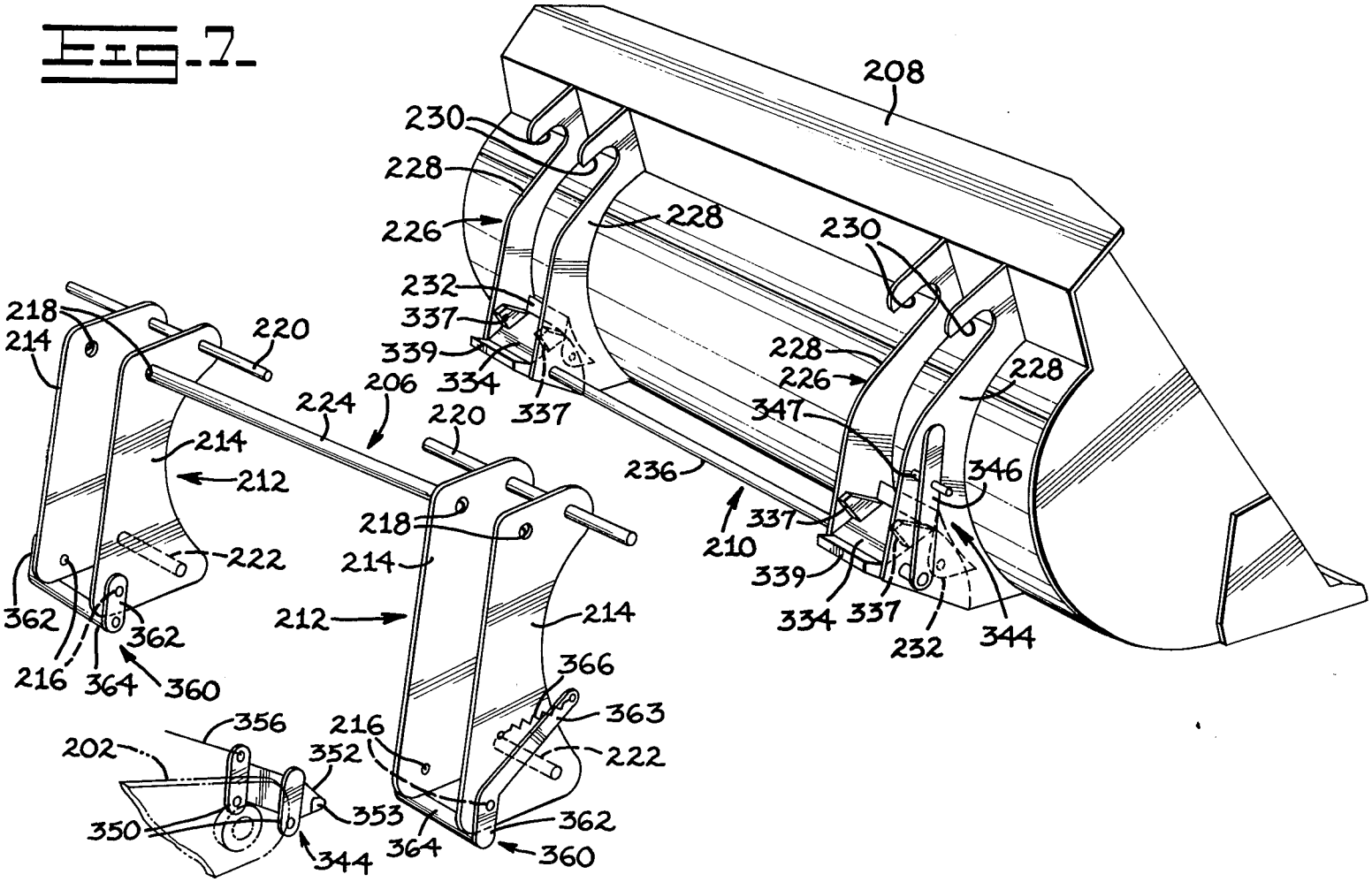
FIG. 7 is an exploded perspective view of a fourth embodiment of the quick coupler according to the present invention.

Referring to FIG. 7, a locking member 334 in the fourth embodiment has a projection 337 of substantially triangular shape at each side edge of its top surface and a rear extension 339 of substantially rectangular shape at the rear edge thereof.

On the other hand, each one of the paired hitch members of the hitch assembly 206 is provided with a safety mechanism 360 with an auxiliary locking member 364 which locks the locking member 334 in the locking position by engaging the above-mentioned rear extension 339 when the locking member 334 is returned to the locking position as will be described hereinafter. The safety mechanism 360 includes a pair of links 362 which are rotatably mounted adjacent the lower end portions of the paired hitch plates 214 of the hitch member 212. The auxiliary locking member 364 is fixedly mounted between the lower end portions of the paired links 362. The outer one of the paired links 362 has an extensive 363 which extends forwardly and upwardly to constitute an auxiliary operating lever for rotating the auxiliary locking member 364, and a tension spring 366 is connected between the fore end of the extension 363 and the outer one of the paired hitch plates 214. The tension spring 366 applies counterclockwise biasing force in FIG. 7 to the paired links 362 and the auxiliary locking member 364, thereby maintaining the paired links 362 and the auxiliary locking member 364 resiliently in the operative positions shown in FIG. 7.

The manual operating lever 346 which constitutes part of a lock releasing mechanism 344 is connected to the opposite ends of the rod 236 through a known play link (not shown) consisting of a spring or a combination of a slot of a predetermined length and a projection located in the slot or the like which has a predetermined play rotation relative to the rod 236 and the locking member 334, the rod 236 and locking member 334 remaining still when the manual operating lever is rotated through a predetermined play angle and being rotated or turned only when the manual operating lever 346 is rotated beyond the predetermined play angle. The manual operating lever 346 is provided with an interlocking pin 347 which engages and causes the upper extension 363 of the auxiliary operating lever to accompany the rotation of the manual operating lever 346.

As shown in the lower left portion of FIG. 7, the lock releasing mechanism 344 is further provided with a pair of links 350 the lower ends of which are rotatably mounted at the fore end of each one of the paired lift arms 202 (only one of which is shown by broken lines) and with a stopper member 352 fixedly mounted on the pair of links 350. The stopper member 352 consists of a piece of substantially triangular shape in section having at lower side edges a notch 353 of the shape complementary to the shape of the projection 337 of the locking member 334. One of the paired links 350 has one end of a flexible wire 356 connected to its upper end portion. The other end of the flexible wire 356 is connected to a control lever (not shown) which is provided at the operator's station of the earthworking vehicle so that the stopper member 352 may be rotated suitably by operating the control lever at the operator's station.

Figures 8A, 8B, 8C:
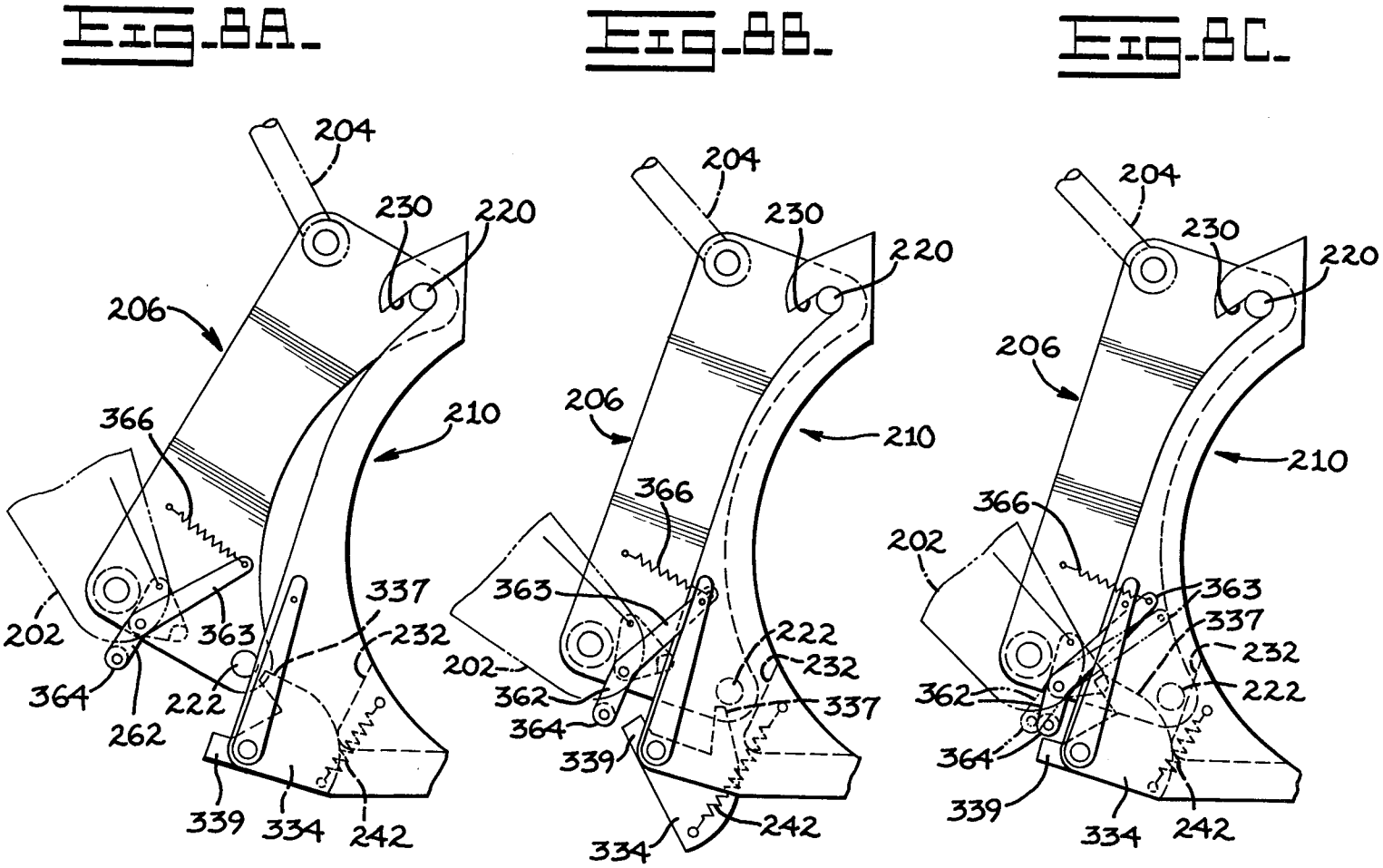
FIGS. 8*a* through 8*g* are fragmentary schematic views explanatory of the operations for coupling and uncoupling the hitch and hook assemblies in the fourth embodiment shown in FIG. 7.

As will be inferable from FIGS. 8*a* through 8*c* which correspond to FIGS. 6*a* through 6*c*, the procedures for coupling the hitch assembly 206 with the hook assembly 210 or the procedures for attaching the working implement 208 to the earthworking vehicle in the fourth embodiment are fundamentally the same as in the third embodiment. In the fourth embodiment, however, when the locking member, 334 which has been urged into the released position of FIG. 8*b* by the movement of the lower coupling member 222 of the hitch assembly 206 relative to the lower receiving portion 323 of the hook assembly 210, is rotated counterclockwise in FIGS. 8*b* and 8*c* to return to the locking position shown in FIG. 8*c*, the extension 339 of the locking member 334 is abutted against the auxiliary locking member 364 to rotate the auxiliary locking member 364 and the paired links 362 clockwise in FIG. 8*c* into the positions shown by two-dot chain line in FIG. 8*c*. When the locking member 334 returns to the locking position shown in FIG. 8*c*, the rear surface portion of the extension 339 of the locking member 334 reaches beyond the lower end of the auxiliary locking member 364, whereupon the auxiliary locking member 364 and the paired links 362 are rotated counterclockwise in FIG. 8*c* by the biasing force of the spring 336 to return to the operative positions indicated by solid line in FIG. 8*c*. The auxiliary locking member 364 returned to the operative position has its lower end engaged with the top surface portion of the extension 339 of the locking member 334 to prevent the latter from rotating clockwise in FIG. 8*c*, thereby holding the locking member 334 in the locking position shown in FIG. 8*c*. Therefore, in the fourth embodiment, the auxiliary locking member 364 of the safety mechanism 360 also serves to hold the locking member 334 in its locking position, preventing doublefold the accidental disengagement of the lower coupling members 222 of the hitch assembly 206 from the lower receiving portions of the hook assembly 210 and further increasing the reliability for safety.

In order to uncouple the hitch assembly 206 from the hook assembly 210 or in order to detach the working implement 208 from the earthworking vehicle, the auxiliary locking member 364 of the safety mechanism 360 is rotated in the first place from the operative position indicated by solid line in FIG. 8*c* to the nonoperative position indicated by two-dot chain line in the same (FIGS. 8*f* and 8*g* indicate the auxiliary locking member in the nonoperative position by solid line) to disengage from the top surface portion of the extension 339 of the locking member 334, relieving the locking member 334 from its locking action. Nextly, the locking member is rotated clockwise in FIG. 8*c* from its locking position of FIG. 8*c* to the released position (shown in FIGS. 8*f* and 8*g*). Thereafter, in the same manner as in the third embodiment, the lower coupling members 222 of the hitch assembly 206 are disengaged from the lower receiving portions of the hook assembly 210, followed by disengagement of the upper coupling member 230 of the hitch assembly 206 from the upper receiving portions 230 of the hook assembly 210.

Either one of the following two methods can be adopted for rotating the auxiliary locking member 364 of the safety mechanism 360 to its nonoperative position and for rotating the locking member 334 from its locking position to its released position.

Figures 8D, 8E, 8F, 8G:
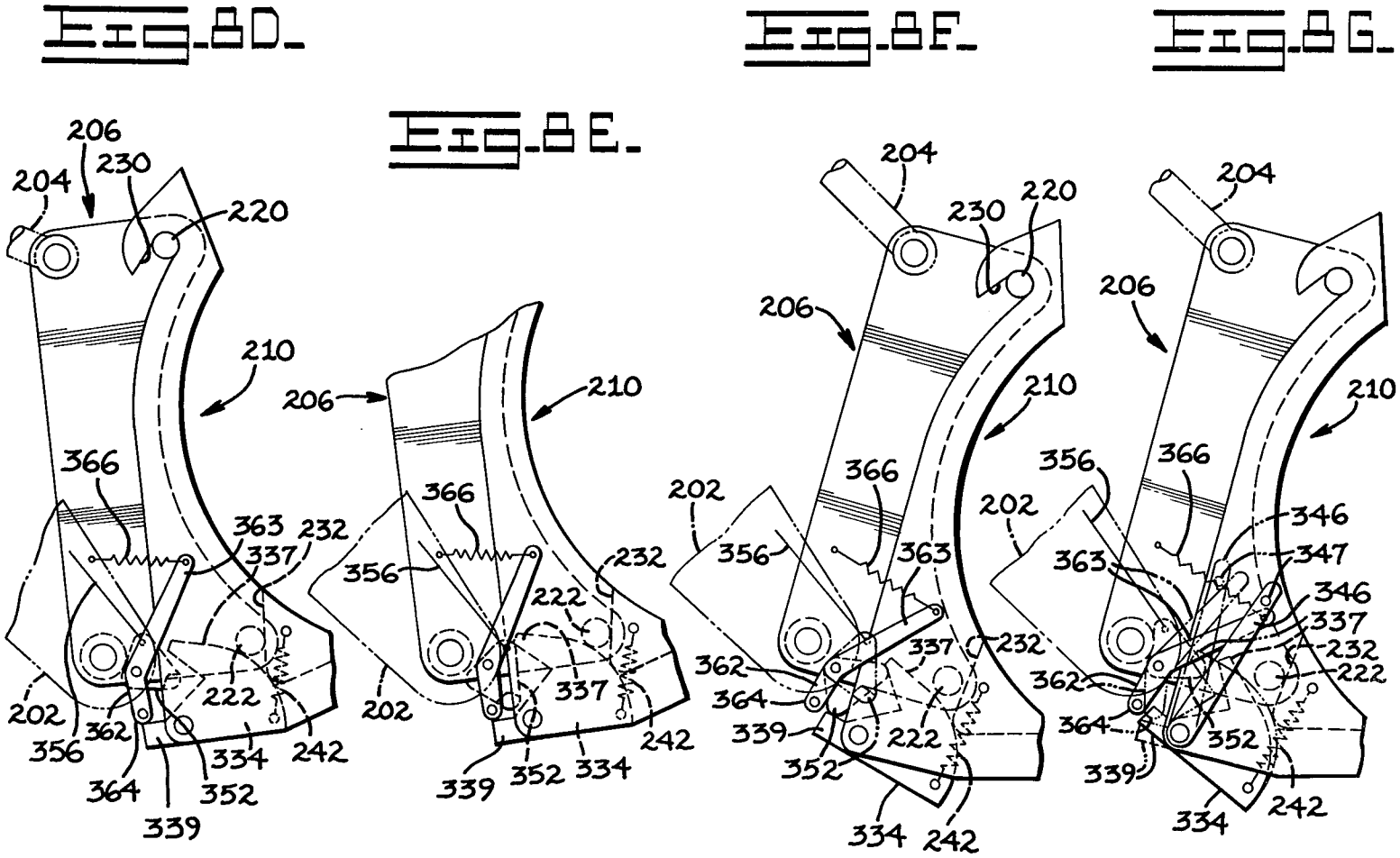

In the first method, as shown in FIG. 8*g*, the manual operating lever 346 is manually turned clockwise in FIG. 8*g* from the position indicated by two-dot chain line to the position indicated by solid line in FIG. 8*g*. In this instance, the locking member 334 remains in the locking position indicated by two-dot chain line in FIG. 8*g* until the manual lever 346 has been rotated to a certain predetermined extent since the locking member 334 is held in the locking position by the auxiliary locking member 364 and the manual operating lever 346 is connected to the rod 236 through the aforementioned play link mechanism. On the other hand, the rotation of the manual operating lever 346 is transmitted through the connecting pin 347 to the extension of the pin 362, namely, to the auxiliary operating lever 363 which is therefore rotated together with the manual operating lever 346 clockwise in FIG. 8*g* from the position indicated by two-dot chain line to the position indicated by solid line in FIG. 8*g*. As a result of this rotation of the auxiliary operating lever 363, the auxiliary locking member 364 is rotated clockwise in FIG. 8*g* from the operative position indicated by two-dot chain line to the nonoperative position indicated by solid line in FIG. 8*g*, thereby disengaging the auxiliary locking member 364 from the extension 339 of the locking member 334 to release the locking member from the locking action of the auxiliary locking member 364. After the initial play rotation of the manual operating lever 346 through the predetermined angle is achieved and the locking member 334 is released from the locking action of the auxiliary locking member 364, the manual operating lever 346 is further rotated clockwise in FIG. 8*g* to rotate the rod 236 and locking member 334 clockwise in FIG. 8*g*. While the manual operating lever 346 is rotated to the position shown by solid line in FIG. 8*g*, the locking member 334 is rotated from the position indicated by two-dot chain line to the position indicated by solid line in FIG. 8*g*.

Figure 9:
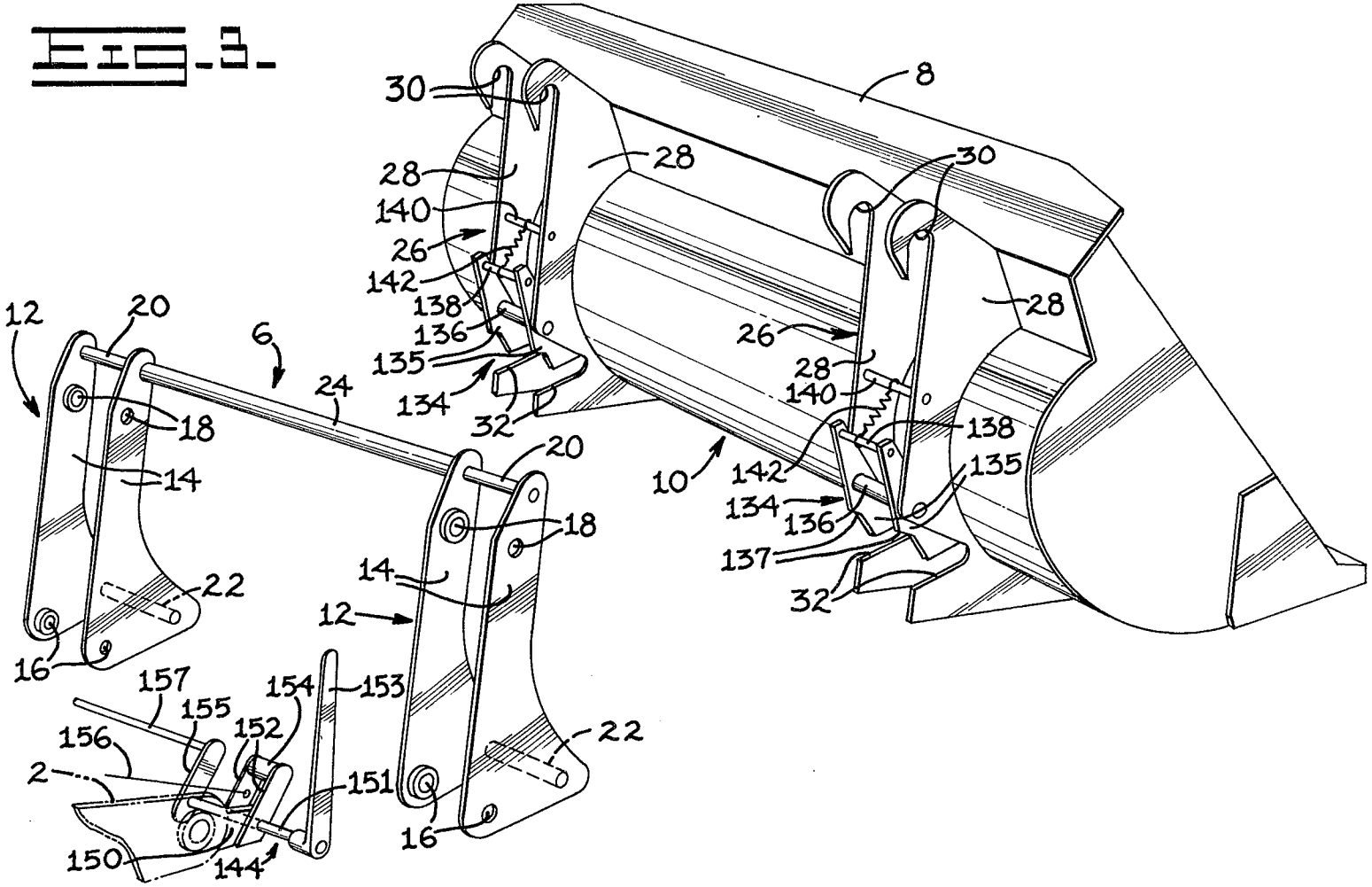

In the second method, the auxiliary locking member 346 and the locking member 334 are rotated automatically by operating the stopper member 352 from the operator's station of the earthworking vehicle. This method is explained more particularly with reference to FIGS. 8*d* through 8*f*. In the first place, the lift arms 202 and tilt links 204 are operated to put the working implement 208 into the state shown in FIG. 8*d*. Then, the control lever (not shown), to which one end of flexile wire 356 is connected, is operated to rotate the stopper member 352 clockwise from the nonoperative position shown in FIG. 8*d* to the operative position shown in FIG. 8*e*. Upon assuming the operative position of FIG. 8*e*, the upper end of the stopper member 352 is abutted against the projection 337 of the locking member 334. Thereafter, the tilt links 204 are tilted forward to rotate the hook assembly 210 and working implement 208 together with the hitch assembly 206 clockwise as seen in FIG. 8*e* and 8*f* about the point of connection between the lift arms 202 and the hitch assembly 206. In this instance, the projection 337 of the locking member 334 which is held in the locking position by the auxiliary locking member 364 (i.e., blocked against rotation relative to the hook member 226) is in contact with the upper end of the stopper member 352, so that the projection 337 of the locking member 334 imposes on the stopper member 352 a force which tends to rotate the stopper member 352 clockwise in FIGS. 8*e* and 8*f*. As a result, the stopper member 352 is caused to rotate clockwise in FIGS. 8*e* and 8*f*. During this rotational movement of the stopper member 352, its lower end abuts against the auxiliary locking member 364 and further rotates clockwise taking the auxiliary locking member 364 therewith. As a result, the auxiliary locking member 364 is rotated clockwise from the operative position of FIG. 8*e* to the nonoperative position shown in FIG. 8*f*. Upon reaching the nonoperative position of FIG. 8*f*, the auxiliary locking member 364 is disengaged from the extension 337 of the locking member 334, releasing the locking member 334 from its locking action. When the auxiliary locking member 364 is rotated to the nonoperative position of FIG. 8*f*, its lower end is abutted against the fore end of the lift arm 202 and thereby its further clockwise rotation is blocked. Therefore, further clockwise rotation of the stopper member 352 which is in abutting engagement with the auxiliary locking member 364 is also blocked. On the other hand, since the locking member 334 is released from the locking action of the auxiliary locking member 364 as described hereinbefore, it becomes possible for the locking member 334 to rotate clockwise in FIGS. 8*e* and 8*f*. Therefore, upon rotating the hook assembly 210 and working implement 208 together with the hitch assembly 206 clockwise in FIGS. 8*e* and 8*f* about the point of connection between the lift arm 202 and the hitch assembly 206, the locking member 334 becomes rotatable clockwise in FIGS. 8*e* and 9*f* under the influence of the force acting between the projection 337 of the locking member 334 and the stopper member 352 which is in abutting engagement therewith, consequently turning from the locking position of FIG. 8*e* to the released position of FIG. 8*f*.

I claim:

1. A quick coupler for detachably attaching an implement to an earthworking vehicle which is provided with a pair of lift arms and a pair of tilt links, said coupler comprising:

a hitch assembly including a pair of transversely spaced hitch members one of which hitch members having upper and lower end portions thereof rotatably linked to one of said tilt links and one of said lift arms, respectively, and the other one of said hitch members similarly having upper and lower end portions thereof rotatably linked to the other one of said tilt links and the other one of said lift arms, respectively, said hitch members each having upper and lower coupling elements respectively in the upper and lower end portions thereof;

a hook assembly fixedly mounted on the back of said implement and including a pair of transversely spaced hook members each having upper and lower end portions, an upper receiving portion in the upper end portion shaped to receive from beneath one upper coupling element of said hitch assembly for engagement with the front, top and rear surface portions thereof and a lower receiving portion in the lower end portion shaped to receive from behind one lower coupling element of said hitch assembly for engagement at least with the front surface portion thereof, a locking member rotatably mounted in the vicinity of the lower receiving portion of each hook member and normally having at least one portion thereof disposed in a normal position interfering with a path of movement taken by said lower coupling element of said hitch member when moved toward said lower receiving portion of said hook member for engagement therewith, said locking member being rotatable into a released position clear of said path of movement when engaging said lower coupling element of said hitch member with said lower receiving portion of said hook member and into a locking position same as or proximal to said normal position as soon as said lower coupling element is engaged by said lower receiving portion of said hook member, said locking member being adapted to be held in said locking position by a force transmitted thereto from said lower coupling element of said hitch member and acting in a direction to disengage said lower coupling element from said lower receiving portion; and an unlocking mechanism linked to each locking member of said hook assembly to rotate said locking members from said locking position to said released position;

wherein said unlocking mechanism is provided with a stopper member rotatably mounted on said lift arm and including means operable at the operator's station of said earthworking vehicle for rotating said stopper member between a nonoperative and an operative position thereof, the fore end of said stopper member being abutted against said locking member of said hook assembly when moved into said operative position, whereupon said implement is tilted forward to cause said locking member to rotate from said locking position into said released position under the influence of the force applied thereto by the abutment of said stopper member.

2. A quick coupler as defined in claim 1, wherein said locking member is rotatably mounted on said hook assembly at a position above said path of movement and movable from said released position to said locking position when rotated downwardly, said locking member being forcibly retained in said normal and locking position by the gravity acting thereon.

3. A quick coupler as defined in claim 2, wherein said hook assembly is provided with a spring for biasing said locking member toward said normal or locking position.

4. A quick coupler as defined in claim 1, wherein said locking member of said hook assembly is rotatably mounted on said hook member at a position below said path of movement and movable from said released position to said normal and locking position when turned upwardly, and said hook assembly is provided with a spring for biasing said locking member into said normal or locking position.

5. A quick coupler as defined in claim 1, wherein said unlocking mechanism comprises a manual operating lever connected to said locking member.

6. A quick coupler as defined in claim 1, wherein a manual operating lever is connected to said stopper member to rotate said stopper member manually between said nonoperative position and said operative position.

7. A quick coupler for detachably attaching an implement to an earthworking vehicle which is provided with a pair of lift arms and a pair of tilt links, said coupler comprising:

a hitch assembly including a pair of transversely spaced hitch members one of which hitch members having upper and lower end portions thereof rotatably linked to one of said tilt links and one of said lift arms, respectively, and the other one of said hitch members similarly having upper and lower end portions thereof rotatably linked to the other one of said tilt links and the other one of said lift arms, respectively, said hitch members each having upper and lower coupling elements respectively mounted in the upper and lower end portions thereof;

a hook assembly fixedly mounted on the back of said implement and including a pair of transversely spaced hooked members each having in the upper end portion thereof an upper receiving portion shaped to receive from beneath one upper coupling element of said hitch assembly for engagement with the front, top and rear surface portions thereof and in the lower end portion a lower receiving portion shaped to receive from behind one lower coupling element of said hitch assembly for engagement at least with the front surface portion thereof, a locking member rotatably mounted in the vicinity of the lower receiving portion of each hook member and normally having at least one portion thereof disposed in a normal position interfering with a path of movement taken by said lower coupling element of said hitch member when moved toward said lower receiving portion of said hook member for engagement therewith, said locking member being rotatably into a released position clear of said path of movement when engaging said lower coupling element of said hitch member with said lower receiving portion of said hook member and into a locking position same as or proximal to said normal position as soon as said lower coupling element is engaged by said lower receiving portion of said hook member, said locking member being adapted to be held in said locking position by a force transmitted thereto from said lower coupling element of said hitch member and acting in a direction to disengage said lower coupling element from said lower receiving portion;

a safety mechanism including an auxiliary locking member rotatably mounted in the lower end portion of said hitch assembly and a spring adapted to bias said auxiliary locking member into an operative position thereof, said auxiliary locking member being adapted to lock said locking member in said locking position upon return thereto when said lower coupling element of said hitch member is engaged by said lower receiving portion of said hook member; and an unlocking mechanism operative to rotate said auxiliary locking member from said operative position to a nonoperative position disengaged from said locking member thereby releasing said locking member from the locking action of said auxiliary locking member, and to rotate said locking member from said locking position to said released position.

8. A quick coupler as defined in claim 7, wherein said unlocking mechanism comprises a manual operating lever connected to said locking member through a predetermined rotational play and an auxiliary operating lever connected to said auxiliary locking member, the rotation through said predetermined play of said manual operating lever relative to said locking member being transmitted to said auxiliary operating lever through a pin provided on said manual operating lever to rotate said auxiliary operating lever from an operative position to a nonoperative position thereof thereby releasing said locking member from the locking action of said auxiliary locking member, and further rotation of said manual operating lever causing said locking member to rotate from said locking position to said released position.

9. A quick coupler as defined in claim 8, wherein said unlocking mechanism comprises a stopper member rotatably mounted on said lift arm and means for rotating said stopper member between a nonoperative position and an operative position thereof, said stopper member being abutted against said locking member when moved into said operative position and in this state said implement being tilted forward, whereupon said stopper member being rotated beyond said operative position by the force applied thereto by said locking member to abut against said auxiliary locking member, thereby rotating said auxiliary locking member into said nonoperative position against each lift arm to unlock said locking member, as a result said locking member being rotated from said locking position to said released position by the force applied to said stopper member by said auxiliary locking member whose rotation is blocked by said lift arm.

* * * * *